US010548414B2

(12) United States Patent
Kologe

(10) Patent No.: US 10,548,414 B2
(45) Date of Patent: Feb. 4, 2020

(54) EXTRUDED SHELVING SYSTEM

(71) Applicant: Joseph F. Kologe, Scranton, PA (US)

(72) Inventor: Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 16/121,144

(22) Filed: Sep. 4, 2018

(65) Prior Publication Data

US 2019/0110610 A1 Apr. 18, 2019

Related U.S. Application Data

(60) Provisional application No. 62/642,222, filed on Mar. 13, 2018, provisional application No. 62/573,503, filed on Oct. 17, 2017.

(51) Int. Cl.

| | |
|---|---|
| ***A47F 1/12*** | (2006.01) |
| ***A47F 7/28*** | (2006.01) |
| ***A47F 5/00*** | (2006.01) |

(52) U.S. Cl.

CPC ..... *A47F 1/126* (2013.01); *A47F 5/005* (2013.01); *A47F 7/285* (2013.01)

(58) Field of Classification Search

CPC ..... A47F 1/126; A47F 7/285; A47F 5/005; A47F 5/132; A47F 7/144; A47F 3/02; A47F 1/04; A47F 7/28; A47F 7/286; A47F 7/288; A47F 1/00; A47F 1/125; A47G 23/02; A47G 23/0266; A47B 57/58; A47B 57/583; A47B 57/585; A47B 57/586; A47B 57/588; A47B 65/00; A47B 65/10; A47B 65/15; A47B 96/04; A47B 73/00; A47B 73/006

USPC ..... 211/184, 85.18, 74, 59.2, 119.003; 108/60, 61

See application file for complete search history.

(56) References Cited

U.S. PATENT DOCUMENTS

| | | | | |
|---|---|---|---|---|
| 4,395,955 A * | 8/1983 | Pfeifer | A47F 5/005 | 108/61 |
| 4,496,037 A * | 1/1985 | Spamer | A47F 1/12 | 193/2 R |
| 4,615,276 A * | 10/1986 | Garabedian | A47F 5/005 | 108/61 |
| 4,712,694 A * | 12/1987 | Breslow | A47F 5/005 | 108/61 |

(Continued)

FOREIGN PATENT DOCUMENTS

EP 0956794 A2 11/1999

*Primary Examiner* — Jennifer E. Novosad
(74) *Attorney, Agent, or Firm* — St. Onge Steward Johnston & Reens, LLC

(57) ABSTRACT

A product display system is comprised of extruded left and right lane members and any number of extruded center lane members. The center lane members are of inverted T-shaped configuration including a vertical center wall and upper and lower base elements extending from opposite sides. The lower base elements are formed across their entire width with closely spaced, alternating grooves and projections. The upper base elements have elements at outer edges thereof to engage with a selected groove and/or projection of an adjacent lane member to form a lane of desired width. Pushers are mounted on the vertical walls to maximize the area available for grooves and projections.

21 Claims, 37 Drawing Sheets

(56) References Cited

U.S. PATENT DOCUMENTS 4,901,869 A * 2/1990 Hawkinson ..... A47F 1/126 211/184
5,097,962 A * 3/1992 Eklof ..... A47B 87/0253 211/184
5,199,584 A * 4/1993 Fowler ..... A47F 5/0043 211/184
5,203,463 A * 4/1993 Gold ..... A47F 1/126 211/184
5,207,334 A * 5/1993 Lear ..... A47J 47/16 211/184
5,265,738 A * 11/1993 Yablans ..... A47F 1/126 211/184
D349,003 S * 7/1994 Horton ..... D6/574
5,450,968 A * 9/1995 Bustos ..... A47F 5/005 108/108
5,542,552 A * 8/1996 Yablans ..... A47F 1/126 211/43
5,634,564 A * 6/1997 Spamer ..... A47F 1/126 211/59.3
5,749,616 A * 5/1998 Steever ..... A62C 27/00 211/184
5,788,729 A * 8/1998 Jurgensmeyer .... B01D 46/0005 55/481
5,839,588 A * 11/1998 Hawkinson ..... A47F 1/126 211/59.3
5,884,782 A * 3/1999 Dembicks ..... B25H 3/06 211/70.6
6,041,720 A * 3/2000 Hardy ..... A47B 96/02 108/60
6,129,218 A * 10/2000 Henry ..... A47F 1/126 211/59.3
6,227,385 B1 * 5/2001 Nickerson ..... A47F 1/126 108/61
6,311,852 B1 * 11/2001 Ireland ..... A47F 1/12 211/184
6,622,874 B1 * 9/2003 Hawkinson ..... A47F 1/126 211/175
6,886,699 B2 * 5/2005 Johnson ..... A47F 1/126 108/61
7,028,852 B2 * 4/2006 Johnson ..... A47F 1/126 108/60
D520,776 S * 5/2006 Richter ..... D20/99
7,124,898 B2 * 10/2006 Richter ..... A47F 1/12 211/59.3
7,500,571 B2 * 3/2009 Hawkinson ..... A47F 1/126 211/59.3
8,016,139 B2 * 9/2011 Hanners ..... A47F 5/005 211/184
8,627,965 B2 * 1/2014 Hardy ..... A47F 1/126 211/59.3
8,752,717 B2 * 6/2014 Bird ..... A47F 1/04 211/184
8,915,381 B2 * 12/2014 Brozak ..... A47F 7/0021 108/61
9,103,580 B2 * 8/2015 Bryson ..... A47F 5/10
9,532,662 B2 * 1/2017 Desmond ..... A47B 96/021
10,159,360 B2 * 12/2018 Bryson ..... A47F 5/0025
2005/0139560 A1 * 6/2005 Whiteside ..... A47B 57/586 211/119.003
2010/0078402 A1 * 4/2010 Davis ..... A47B 57/585 211/184

* cited by examiner

EXTRUDED SHELVING SYSTEM

FIELD OF THE INVENTION

The invention is directed to a shelving system which is particularly directed to, although not necessarily limited to, the shelf presentation of products supplied in cylindrical containers. The new system utilizes inexpensive extruded shelving units in a unique way, enabling them to easily be assembled and reassembled to form a wide variety of lane widths to accommodate the display and delivery of a wide variety of cylindrical containers.

BACKGROUND OF THE INVENTION

In connection with the display of products in cylindrical containers, which includes, but is by no means limited to, single serve beverages, there has been an ongoing problem involving the setting of product lanes to desired widths to receive the containers, and the adjustment of lane widths from time to time to receive product containers of different sizes. One widely used system for dealing with these issues involves providing a structure at the front of a shelf, with means at the front for positioning and fixing individual product lanes, with each lane typically comprising a bottom wall and a vertical divider wall, together with pusher means for advancing a column of products in the lane toward the front for display and removal. These systems, although somewhat costly, are less than satisfactory for the display of cylindrical containers. When a product lane is filled with a column of such containers, and pressure is applied from the back to advance the column to the front, some of the cylindrical containers will tend to be displaced laterally, unless closely confined by a pair of vertical divider walls. However, since adjacent lane structures are attached only at the front, it is more difficult to resist the considerable lateral forces applied to adjacent divider walls by cylindrical containers at the back of a column of such containers.

The use of extruded lane-forming elements has been proposed, which has advantages for displaying cylindrical products because adjacent lanes can be attach to each other over their full length and can effectively resist a tendency for a column of cylindrical containers to become misaligned when pressure is applied to the back to the column to maintain the products properly "fronted". However, existing designs of such extruded lane-forming structures have not been commercially successful because of limitations in the ability of adjust lane width over an adequate range. The Hawkinson U.S. Pat. No. 6,622,874, for example, shows an extruded lane structure which, although providing for full length attachment of adjacent lane parts, has a very limited range of adjustment and, as a practical matter, requires the use of separate connector elements for joining adjacent lanes of a display. The Johnson et al. U.S. Pat. No. 6,886,699 illustrates another type of extruded lane structure which also has a limited range of lane width adjustment because of the presence of a pusher track in the center of each lane.

SUMMARY OF THE INVENTION

The extruded shelf system of the present invention comprises a plurality of interlocking, extruded lane-forming members, and the ability to interlock the lanes in a wide variety of adjustable widths without the need for a front rail. The basic system includes a left hand lane, a center lane and a right hand lane. One left hand lane and one right hand lane can be used with any number of center lanes to outfit a shelf or a run of lanes across two or more shelves. To satisfy any number of facings per shelf run without the need for delivering special box packs to the store, the lanes can be boxed with right hand and left hand lane pairs in one box and center lanes in other boxes. By adjusting the number of boxes, any store set can be satisfied. The ability to serve and stock any shelf depth requirement with standardized box-packs is economically advantageous and of great convenience to the store keeper.

Each of the center lane members of the new shelf system is of an inverted T-shaped configuration and includes, in addition to a vertical divider wall, upper and lower base elements extending horizontally from opposite sides of the divider wall. The lower base element is formed across the full width thereof with closely spaced alternating grooves and upward projections, the grooves being defined by adjacent pairs of the projections. The upper base element is disposed at a level slightly above that of the lower base element such that, in an assembly of two or more adjacent center lane members, the upper base element overlies the lower base element of an adjacent center lane member. The upper base element is provided at its outer edge with a downwardly projecting element which is configured for engagement with a projection and/or groove of the underlying lower base element, enabling the two center lane members to be interlocked at a selected width over their full length. The respective left and right lane members are formed with base elements of the appropriate upper or lower type so as to be adjustably engageable with an adjacent center lane member in the same manner as in joining two center lane members.

In one advantageous form of the invention the downwardly projecting element of the upper base element is configured to facilitate the disconnection of two lane members, when desired, as for changing the width of a lane, upon tilting action of a lane member, particularly at the back of the lane.

In some circumstances, a shelving system according to the invention may be set on an incline, relying on gravity to feed the individual containers toward the front. In most cases, however, a pusher system will be employed to move the products forward. Importantly, in the shelving system of the invention, a pusher, if used, is mounted on the vertical divider panel and not on either of the base elements. While it is known to mount pushers on vertical divider walls of shelf divider systems, there are unique and unobvious advantages to utilizing divider mounted pushers in connection with the disclosed incrementally width-adjustable shelving systems of extruded construction, in which adjacent lane-forming members are connected together over their full lengths. In particular, this arrangement enables the lower base element of a lane-forming member to be provided across its full upper surface with closely spaced, alternating grooves and projections, maximizing the adjustable width range of the structure and enabling narrower minimum width settings to accommodate small diameter containers. The entire structure, with improved functionality, is uniquely simplified, easy to set up and change, and highly economical to manufacture, install and maintain. In a simple and practical commercial embodiment of the invention, it is a simple matter to provide for as many as a dozen lane widths to accommodate the variety of cylindrical containers.

In the system of the invention the vertical walls of the extruded parts are formed with a plurality of track-forming flanges on one side thereof which extend out from an otherwise generally flat wall and form one or more opposed grooves for the slidable reception and support of a pusher, which typically is spring driven.

While the shelving system of the invention can be utilized without incorporating a front product stop, as where such may be already integrated into the store shelves, one aspect of the invention is the provision of a particularly advantageous form of front product stop and of provisions for mounting the same at the front of at the front of a vertical wall of a center lane member or end lane member. Pursuant to the invention, as the extruded vertical walls exit the extruder equipment and are cooled, a front portion of the extrusion is subjected to cutting and punching operations to cut away, along a vertical path spaced a short distance behind the front edge, portions of the track-forming flanges, leaving plurality of vertically aligned segments thereof between the vertical path and the front edge of the extrusion. An advantageous form of front product stop, of molded construction, is formed with a vertical passage, to receive the vertically aligned track segments, and with a connected vertical slot to engage the vertical divider wall in the region of the vertical path. The product stop snaps in place and provides a barrier on opposite sides of a divider wall and on the lane side of a vertical wall of a left or right lane member.

In a typical case, the pushers are urged forwardly by means of coiled strip springs. The spring coils are housed in the pushers with the strips extending forward and anchored on the vertical wall. In one advantageous form of the invention, the pushers are formed with two vertically aligned compartments for receiving coiled springs. Typically only one spring is supplied. However, if the nature of the product (e.g., weight, size) warrants, the store keeper can easily and quickly install a second spring.

For a more complete understanding of the above and other features of the invention, reference should be made to the following description of preferred embodiments of the invention and to the accompanying drawings.

DETAILED DESCRIPTION OF THE INVENTION

Figure 1:
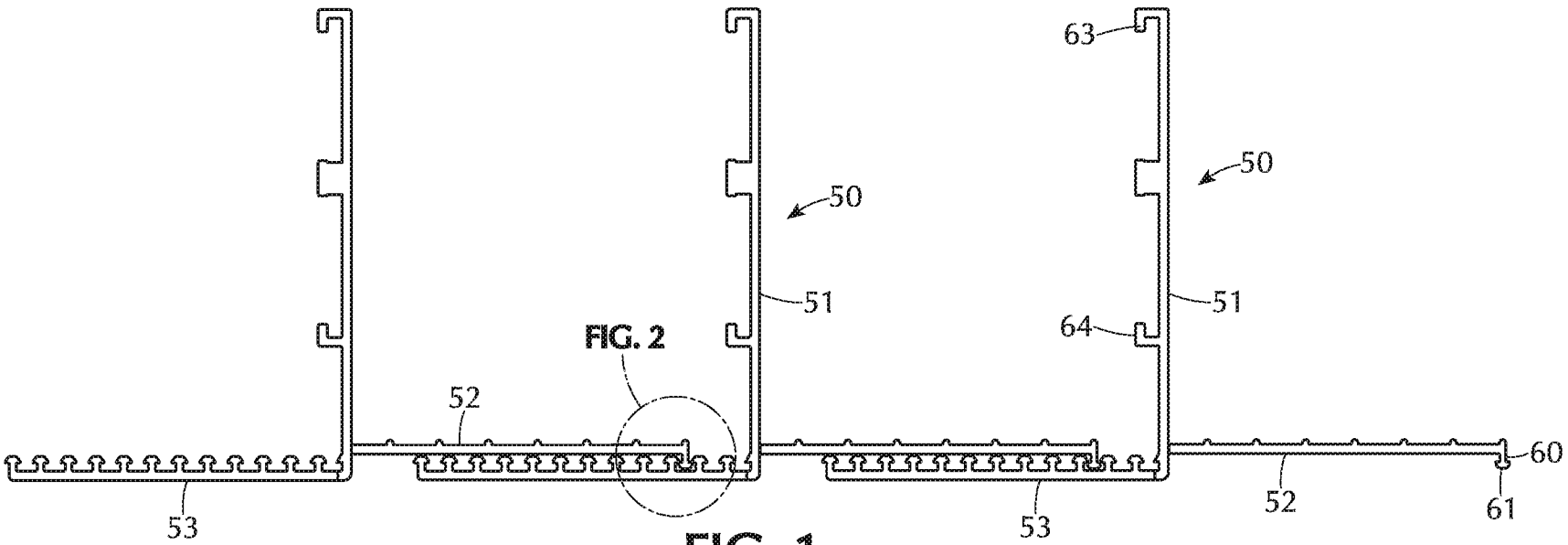
FIG. 1 is an end elevational view of a partial shelf assembly according to the invention, made up of three center lane members, as viewed from the back.
Figure 3:
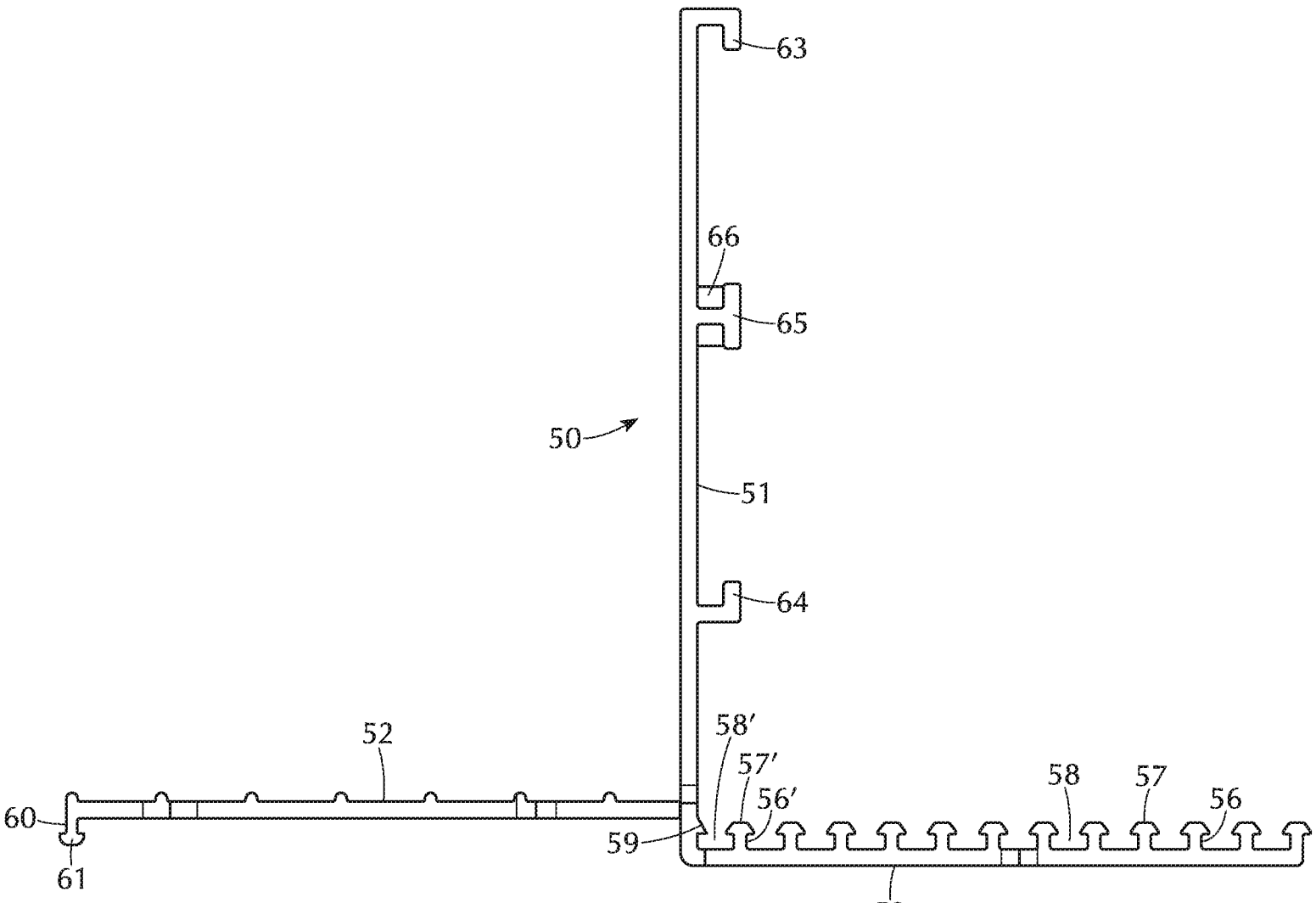
FIG. 3 is an enlarged end elevational view of a single center lane member, as viewed from the front.
Figure 3B:
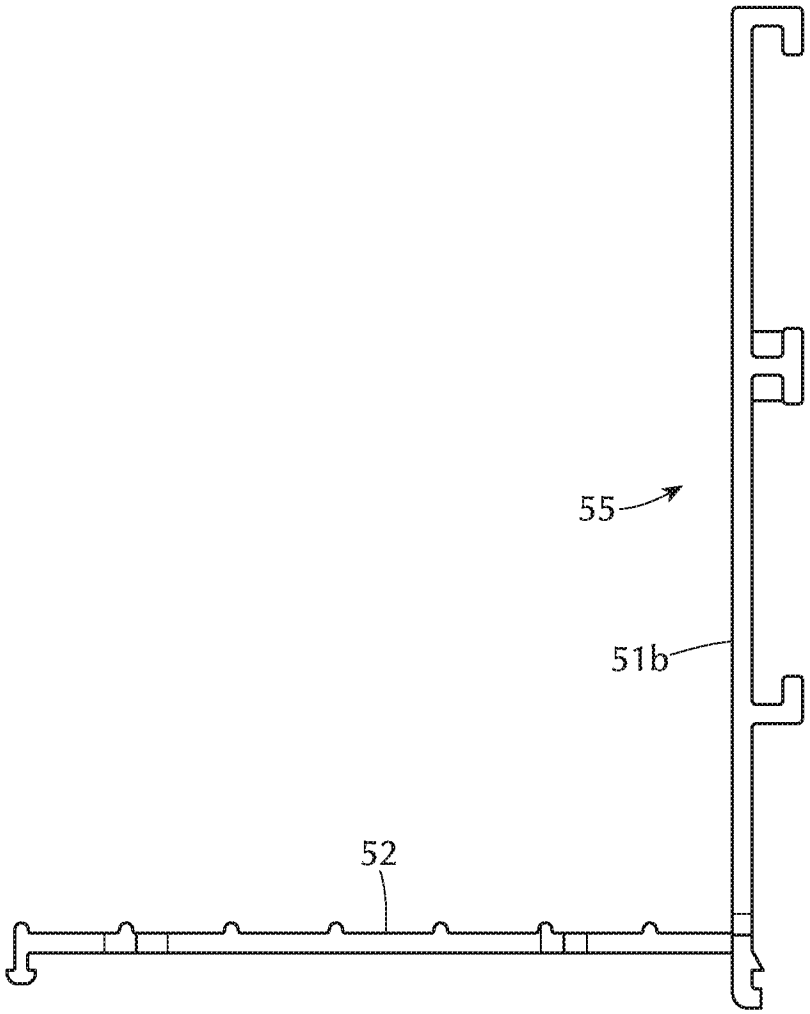
FIG. 3B is an enlarged end elevational view of a right lane member, as viewed from the front.
Figure 3A:
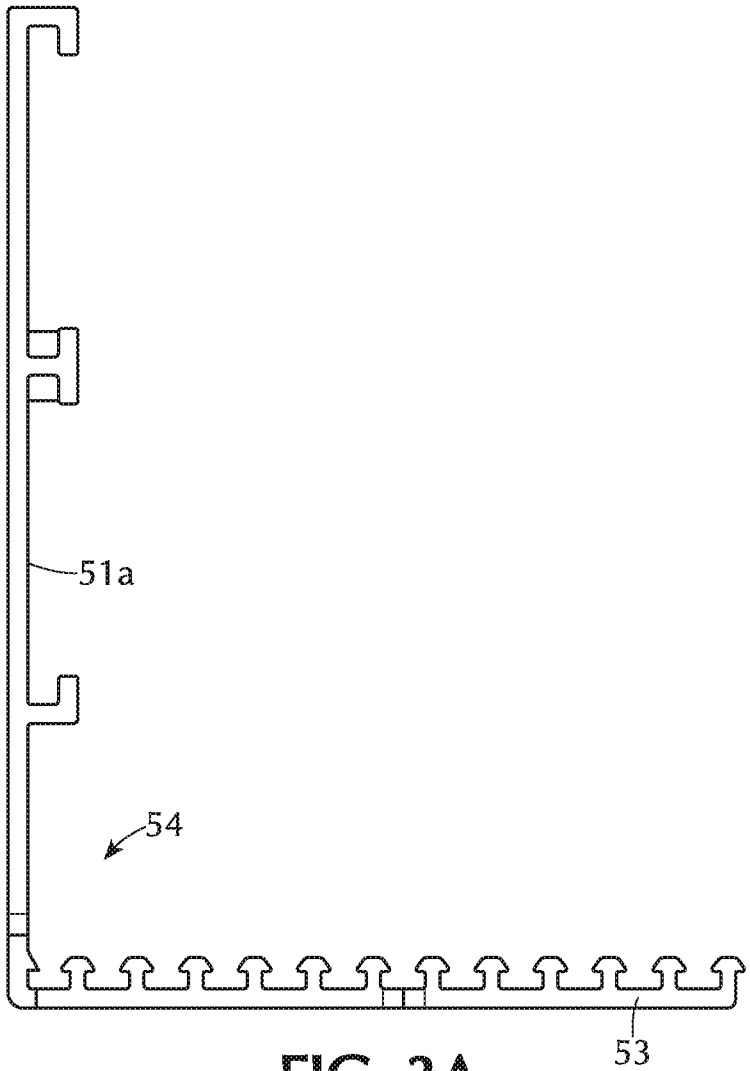
FIG. 3A is an enlarged end elevational view of a left lane member, as viewed from the front.
Figure 4:
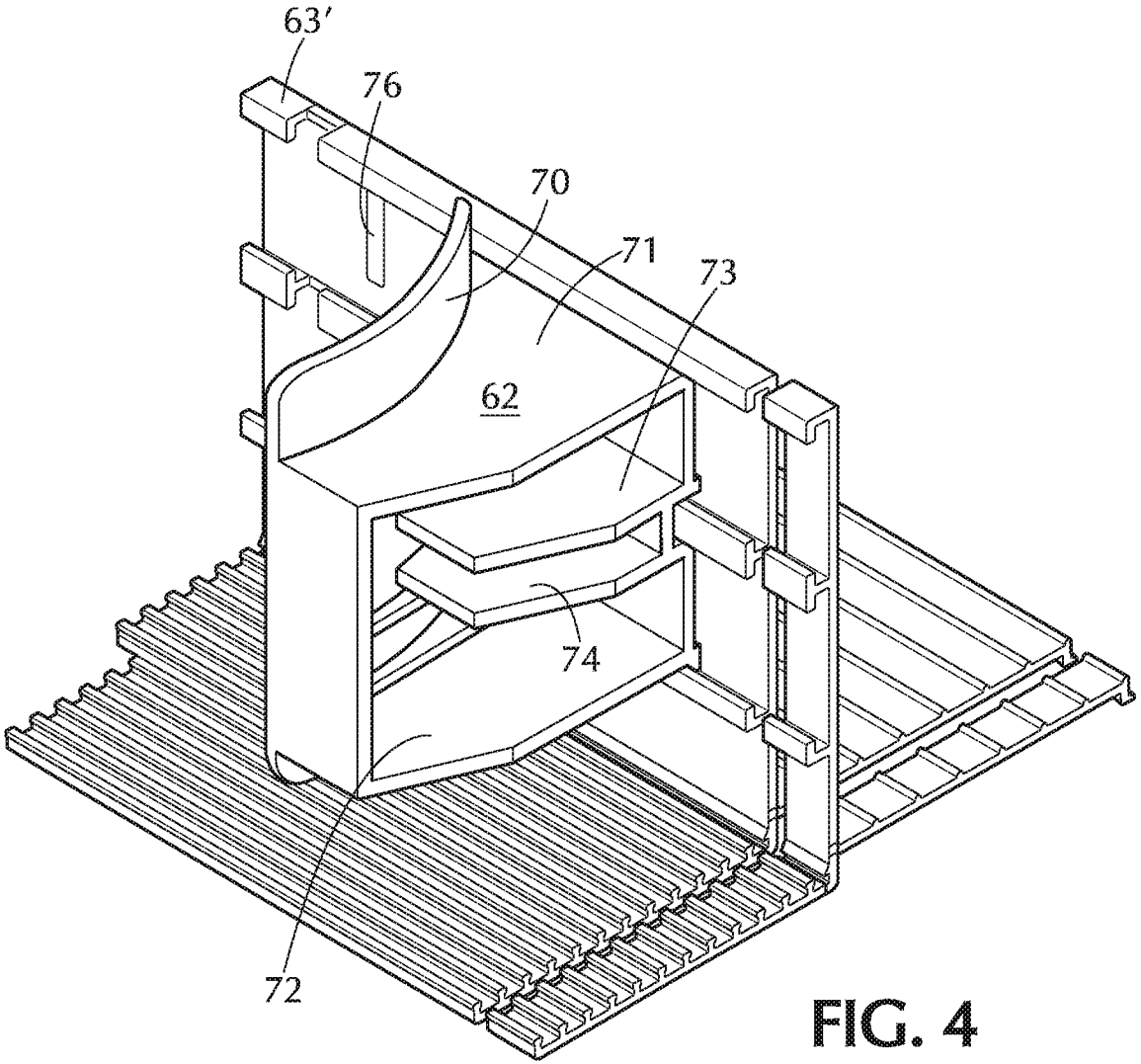
FIGS. 4 and 6 are orthographic views from behind and in front, respectively, of a center lane member with a pusher mounted on the vertical wall thereof.
Figure 5:
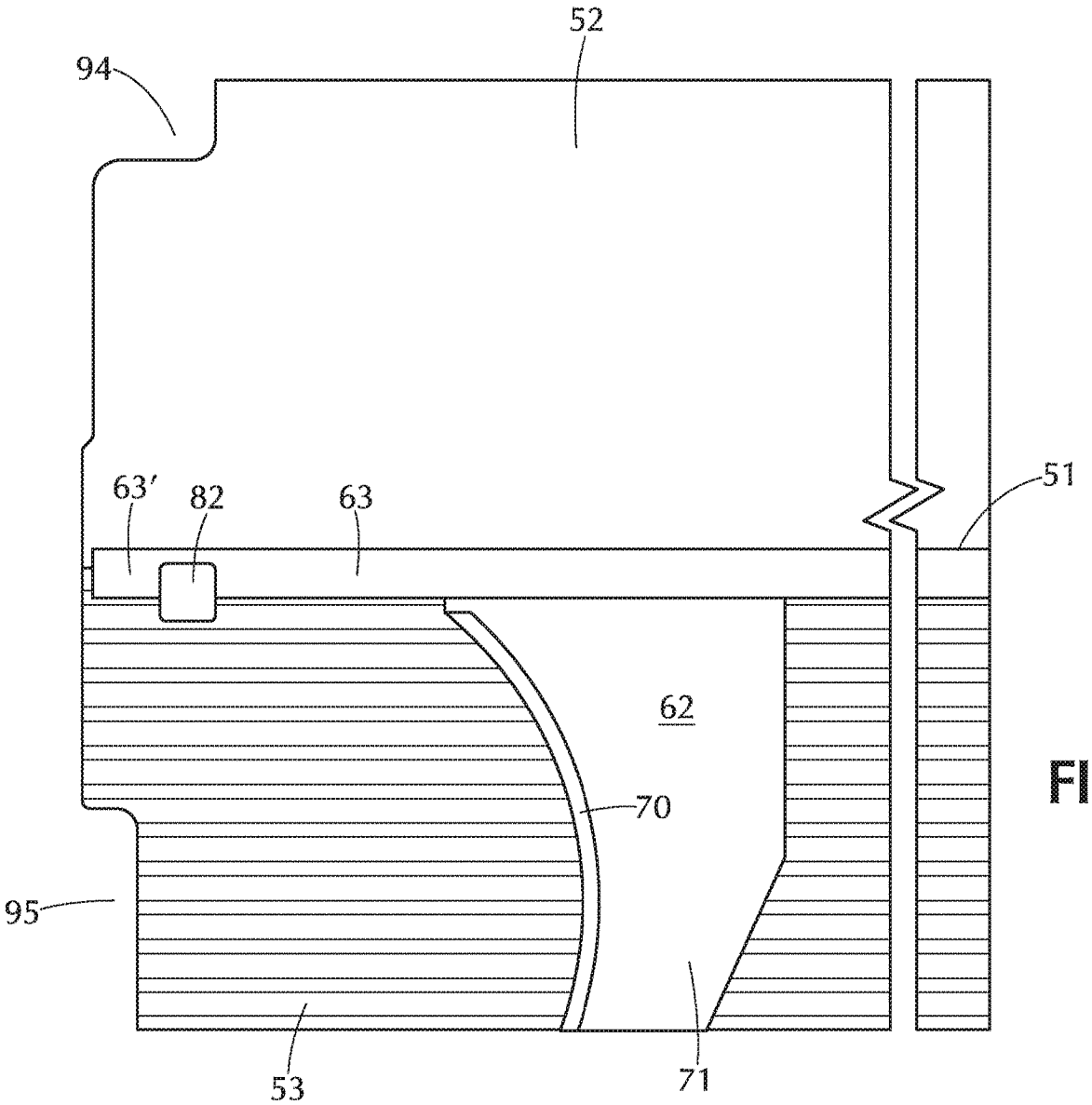
FIG. 5 is a top plan view of the assembly of FIGS. 4 and 6.
Figure 6:
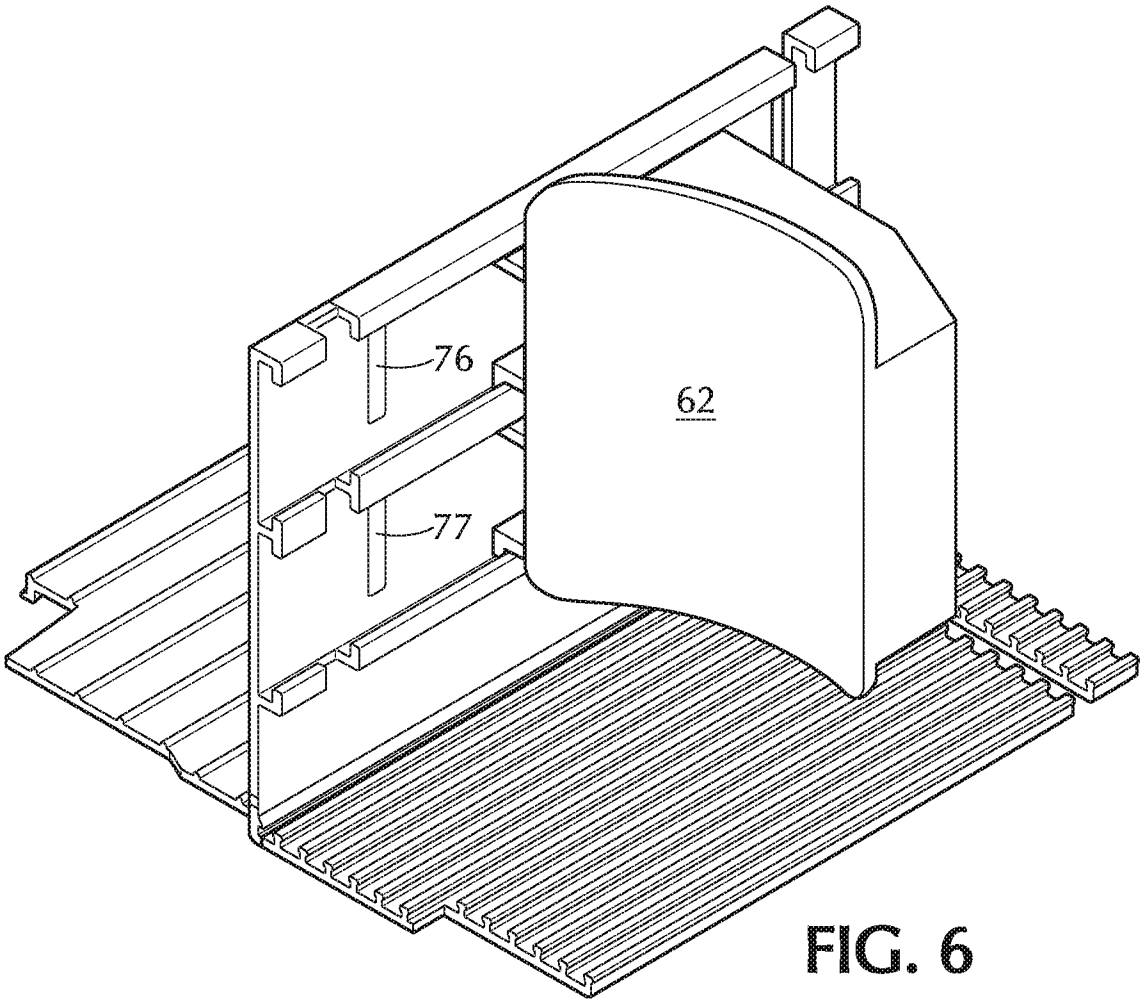
Figure 7:
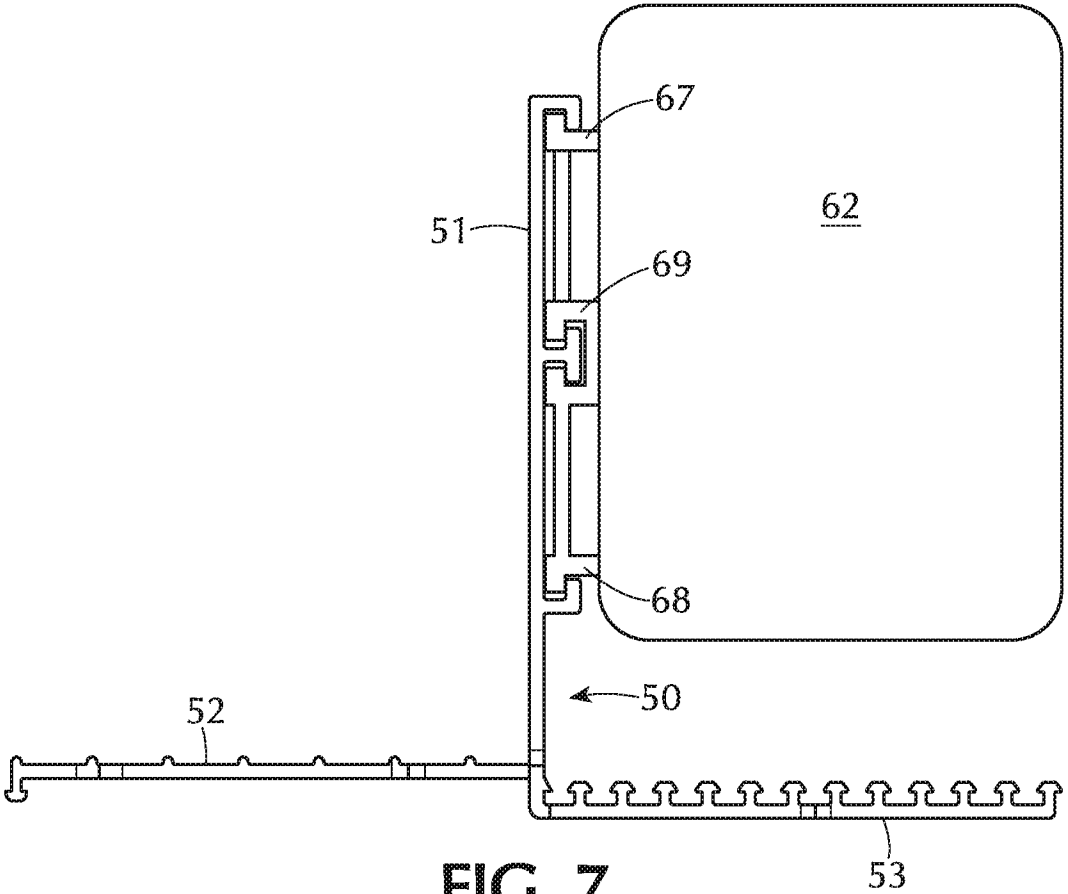
FIGS. 7-9 are front, side and back elevational views, respectively, of the assembly of FIGS. 4 and 6.
Figure 8:
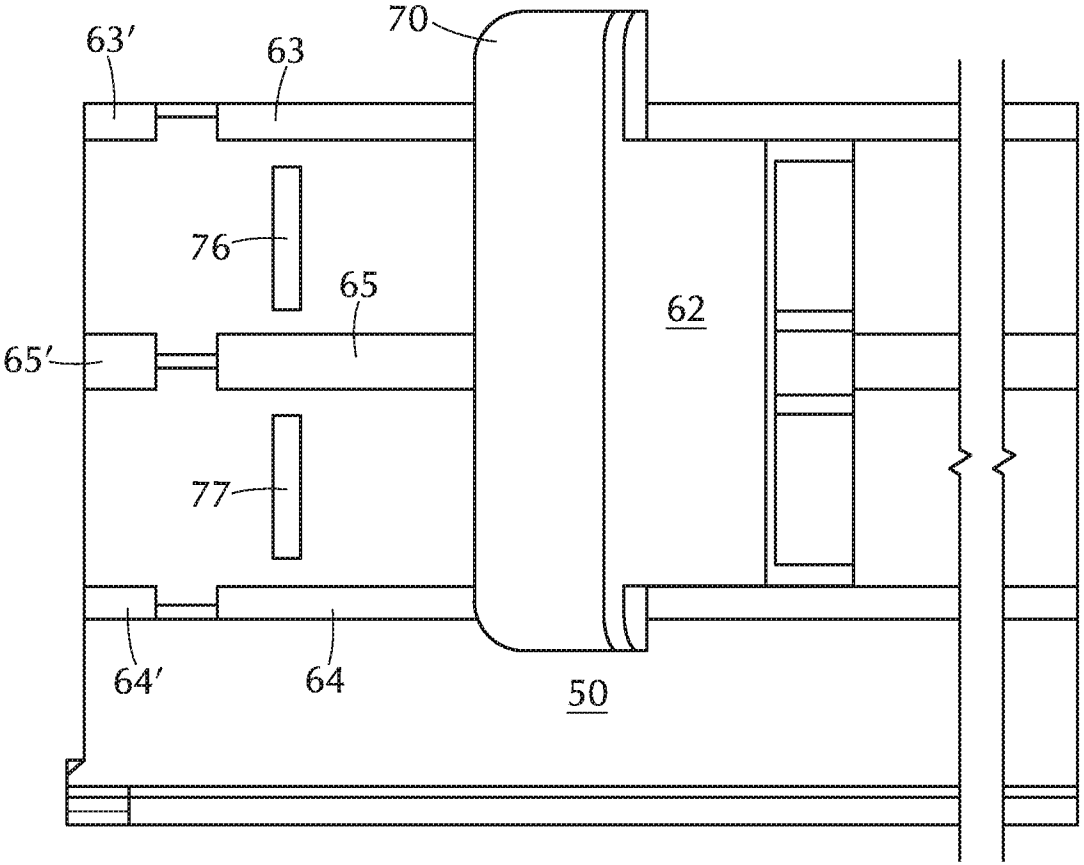
Figure 9:
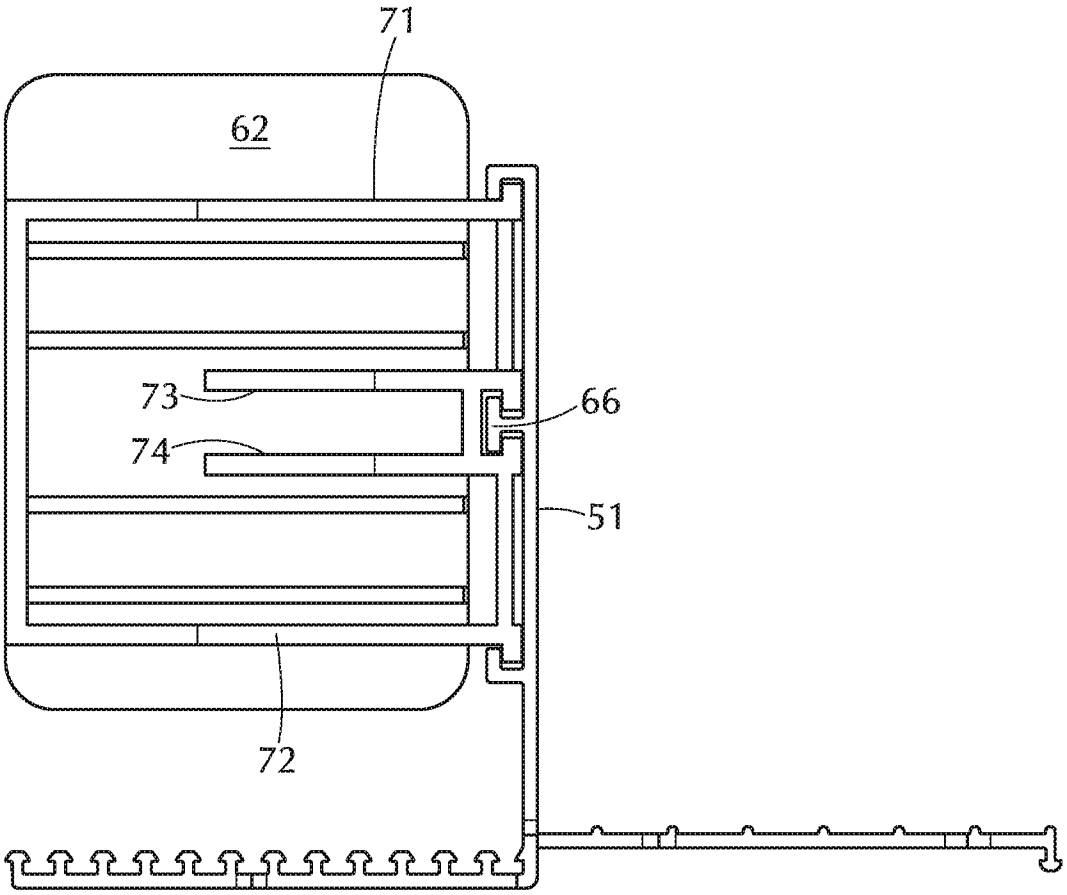

Referring to the drawing, the basic extruded components of the new system are the center lane member 50, in the form of an inverted "T", the left lane member 54, in the form of an "L", and the right lane member 55, in the form of a reverse "L". The center lane member 50 is shown in FIGS. 1 and 3 and comprises a vertical divider wall 51 and upper and lower, horizontal base elements 52, 53. With reference to FIG. 3A, a left lane member comprises a vertical wall 51*a* and a lower base element 53, and a right lane member 55 comprises a vertical wall 51*b* and an upper base element 52. A shelving assembly can be created by connecting together a plurality of center lane members 50, as reflected in FIG. 1, and connecting left and right lane members at the opposite sides. For example, a left lane member 54 attached to the upper base element 52 of a center lane member 50 of FIG. 3, and a right lane member 55 attached to the lower base element 53 of the same center lane member 50 provides a two-lane assembly. An assembly of any number of lanes may be provided by adding more center lane members.

In the first illustrated form of the invention, the lower base element 53 is formed with a plurality of closely spaced upwardly extending projecting elements 56, each having a flange 57 at the top. The tops of the flanges 57 are rounded or tapered at their side edges, providing somewhat of a mushroom-shaped cross section and partially closing the tops of grooves 58 formed between the projecting elements 56. The groove 58' closest to the vertical divider wall 51 is defined in part by a lower portion of the wall 51 and a short projection 59 which extends from the wall 51 and cooperates with the adjacent projecting element 56' and flange 57' to define the groove. As will be understood, the projecting elements 56, flanges 57 and grooves 58 extend for the full length of the extruded center lane member, which is cut to a length appropriate for the store shelf structure on which it will placed.

Figure 2:
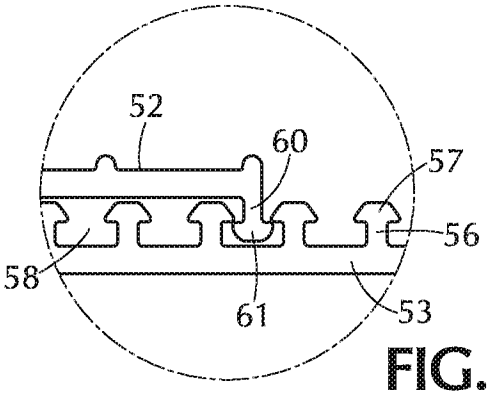
FIG. 2 is an enlarged, fragmentary view of Detail A of FIG. 1, showing one advantageous form of interlocking structure.

As shown in FIG. 3, the upper base element 52 of the center lane member 50 is provided at its outer extremity with a downwardly extending engagement projection 60 having a flange 61 at its lower end, which is rounded or tapered at its opposite sides. The width of the engagement flanges 61 is slightly greater than the space between adjacent flanges 57, as reflected in FIG. 2 of the drawings. Accordingly, to connect one center lane member to an adjacent center lane member, or to a left lane member, the engagement projection 60, which extends for the full length of the extruded center lane member 50, is aligned with a desired groove 58 and downward pressure is applied over the top of the upper base element 52. This causes the projection 60 and its flange 61 to enter the selected groove 58 with somewhat of a snap-action to securely lock the two lane members together over the full length thereof. The lane members are extruded of a suitable plastic material, such as polyvinyl chloride which, while being relatively rigid, for the support of a column of displayed beverage containers (for example), has sufficient elasticity to accommodate the desired snap-in assembly. As can be seen in FIGS. 1 and 2, the length of the engagement projection 60 preferably is no greater than the depth of the grooves 58, so that, when two lane members are assembled, the upper base element 52 will be supported by the tops of the flanges 57.

As reflected in FIGS. 1-3, the nature of the grooves 58 and projections 60 is such that the grooves can be spaced closely together. Thus, in a typical commercial embodiment of the invention, it is a simple matter to provide as many as twelve rows of grooves in a base element of approximately two inches in width. This enables any two adjacent lane members 50, 54, 55 to be assembled at 12 different lane widths, easily accommodating the wide variety of container widths normally encountered.

In accordance with an aspect of the invention, the divider walls 51 are configured to carry a pusher 62 (FIGS. 4-9) for urging products to the front of the display. For this purpose the divider walls are extruded with upper and lower L-shaped track flanges 63, 64 and a T-shaped track rail 65 centered between the track flanges 63, 64. Preferably, the track rail 65 is crimped at the back end to form a stop 66 to limit rearward movement of the pusher. The pusher 62 is provided with L-shaped flanges 67, 68 configured for sliding engagement with the divider track flanges 63, 64 and with a channel 69, centered between the flanges 67, 68 for sliding engagement with the T-shaped track rail 65. The front wall 70 of the pusher preferably has a forwardly concave contour, when used in connection with products in cylindrical containers, such as single serve beverages. For other products, for example products in bags or rectangular boxes, the front wall might be flat.

Figure 18:
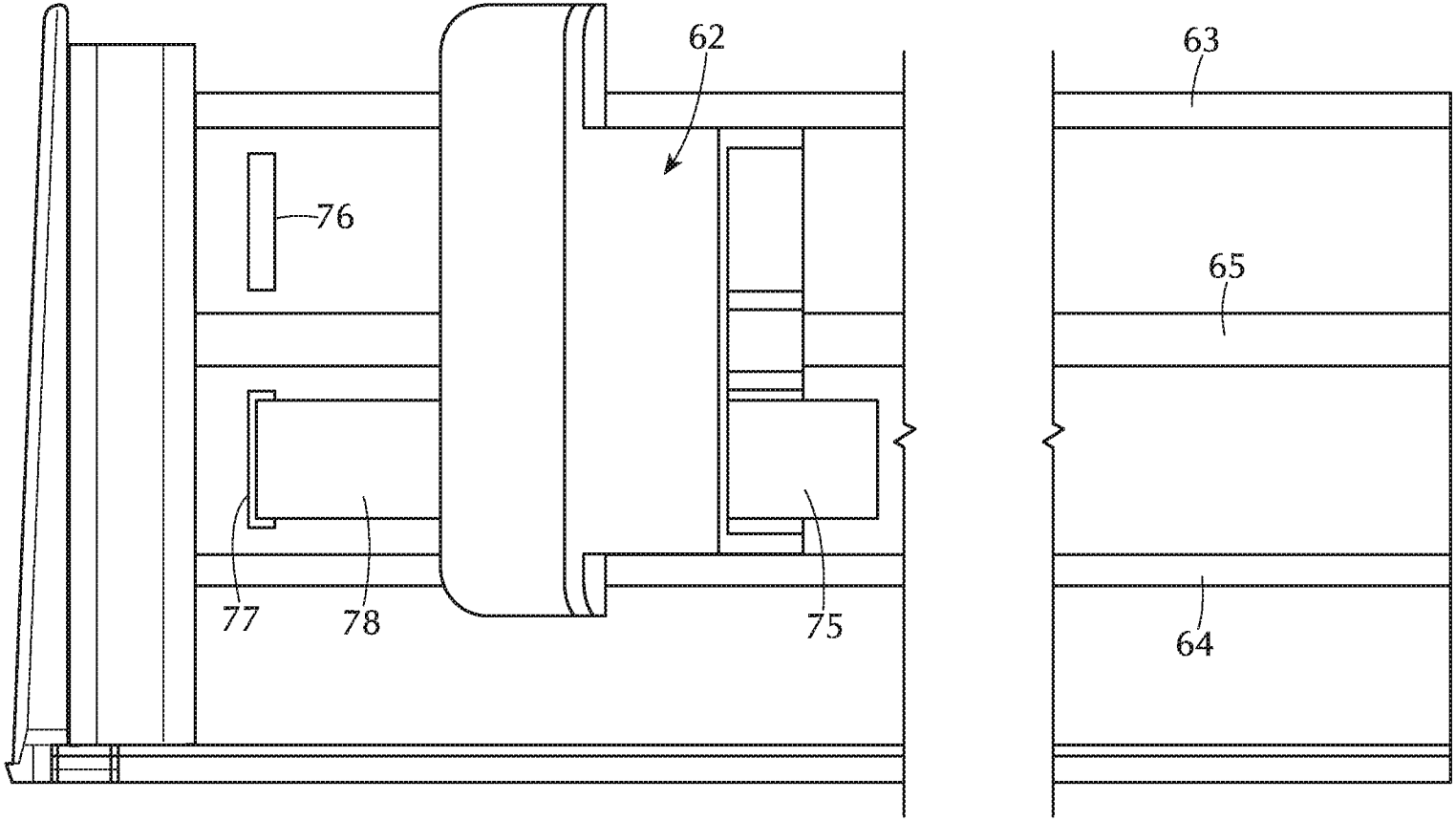
Figure 19:
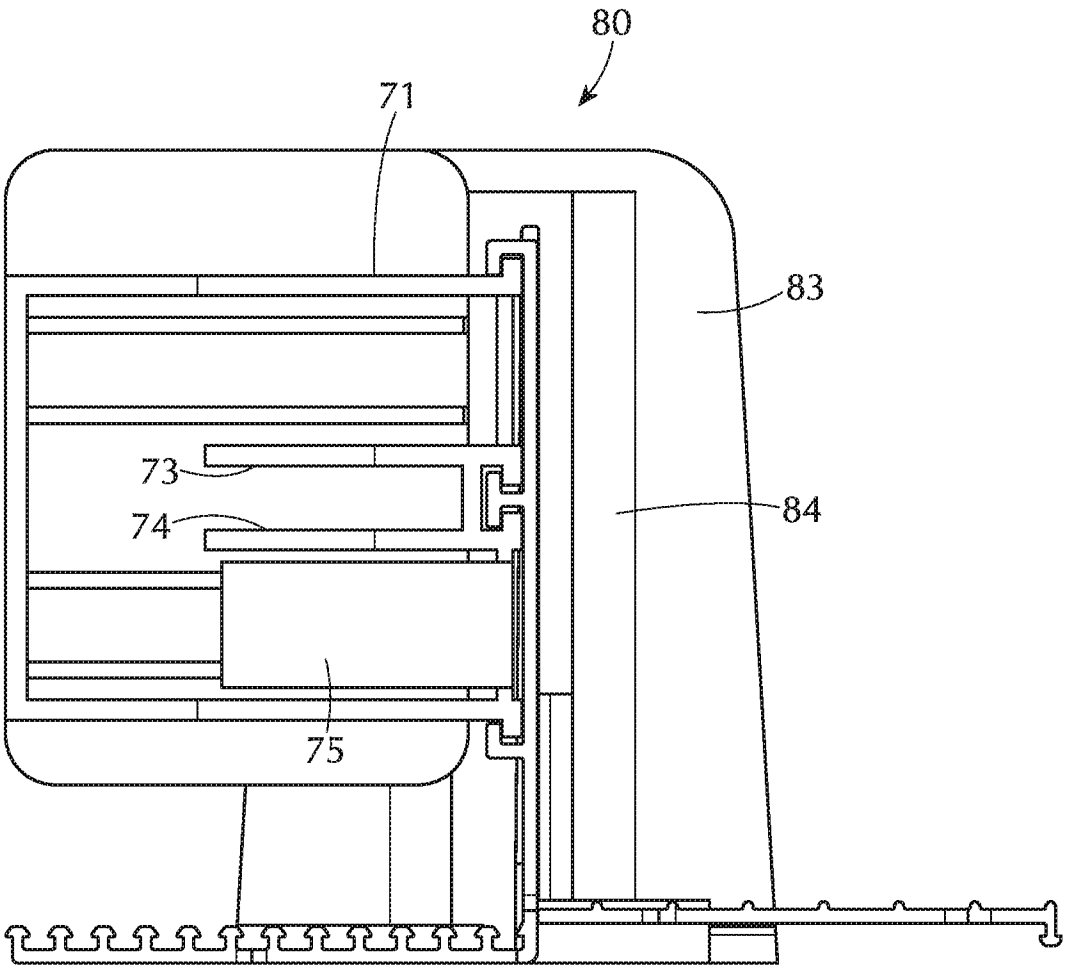
Figure 20:
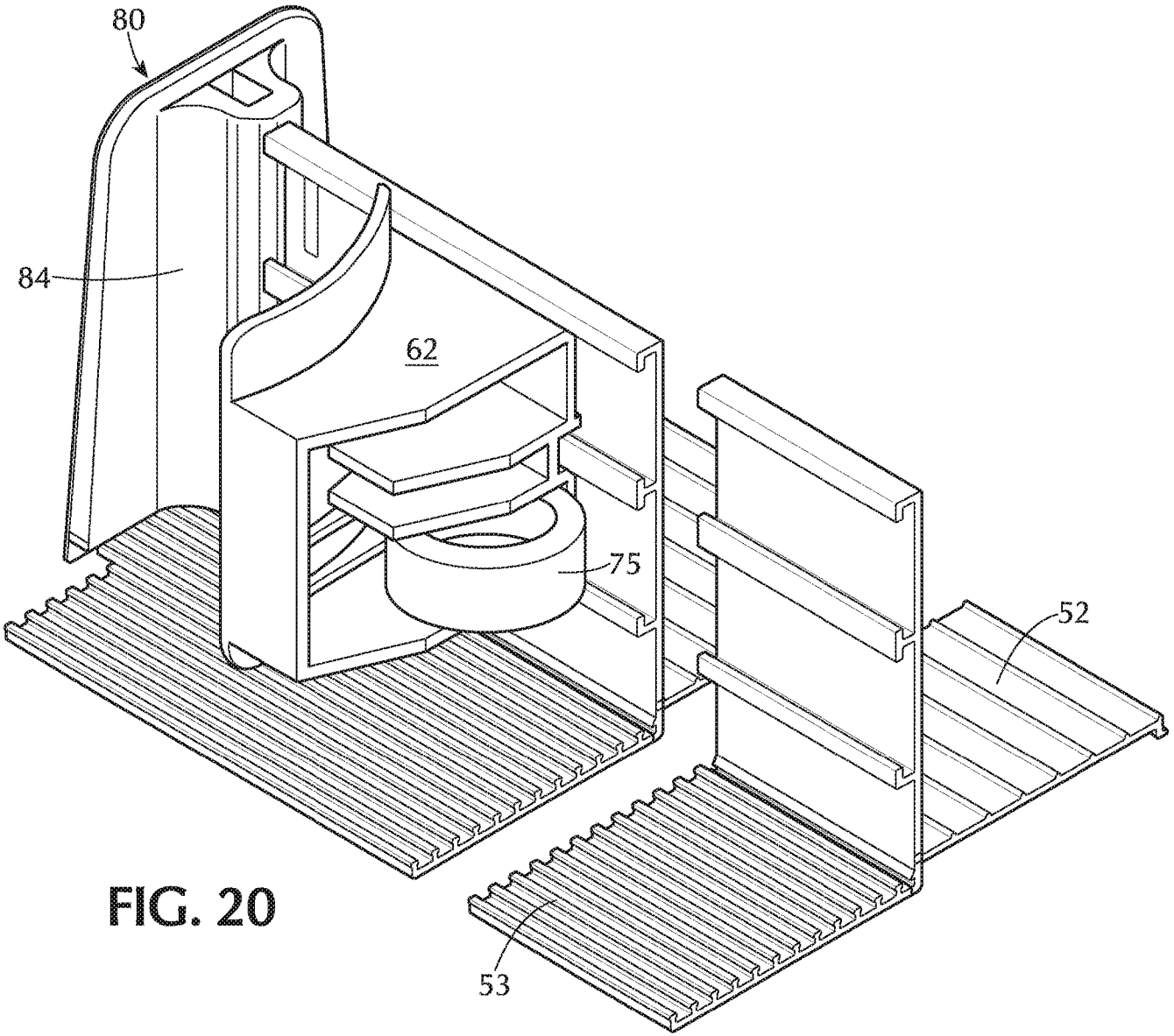
Figure 22:
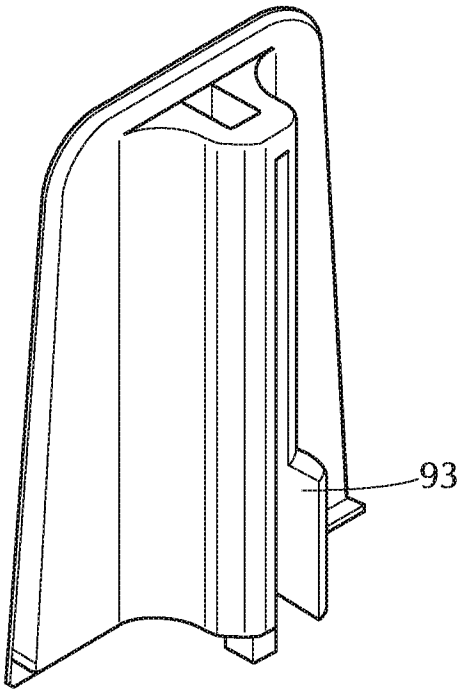
FIGS. 21, 22, and 24-26 are various orthographic views of one advantageous form of product stop, as used in the assembly of FIGS. 15-20.
Figure 21:
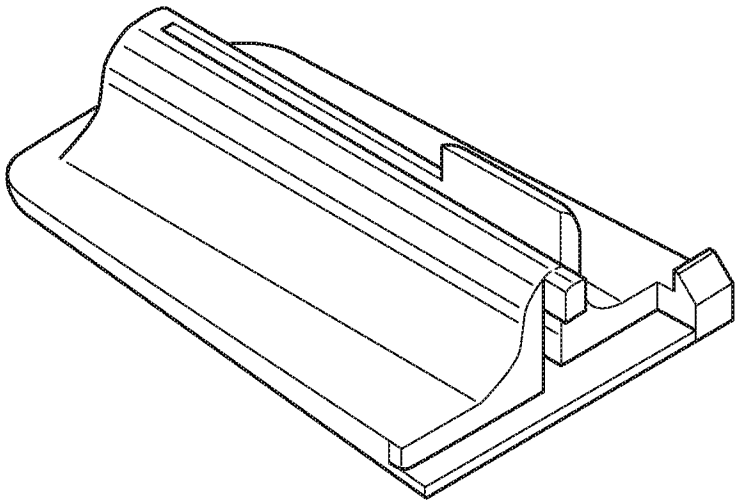
Figure 24:
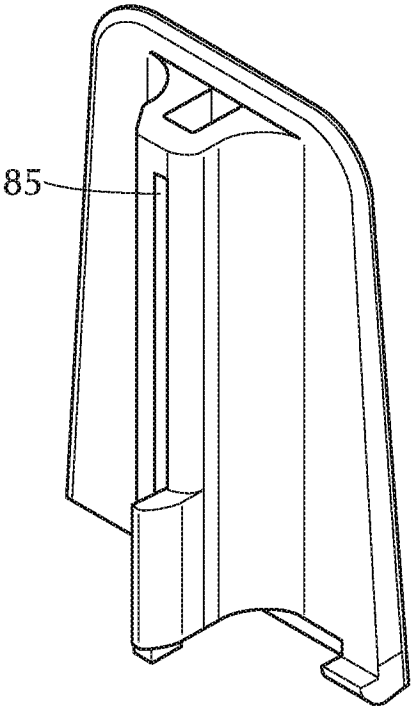
Figure 23:
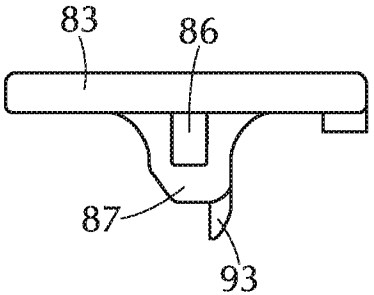
FIGS. 23 and 31 are top and bottom plan views, respectively, of the product stop.
Figure 26:
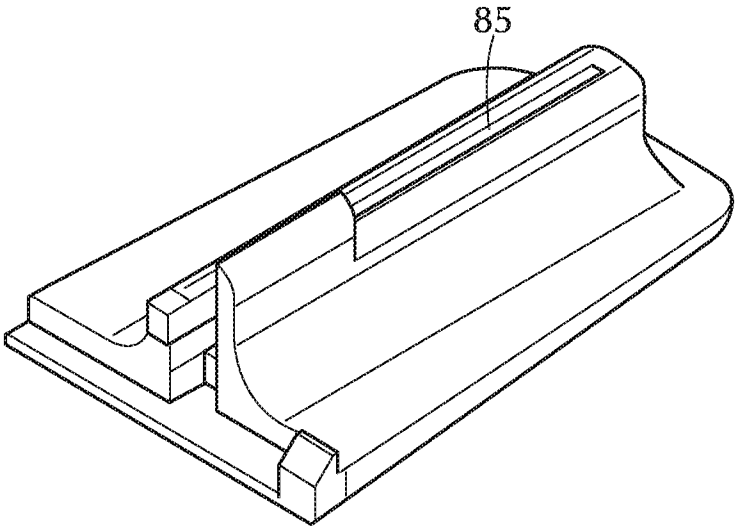
Figure 25:
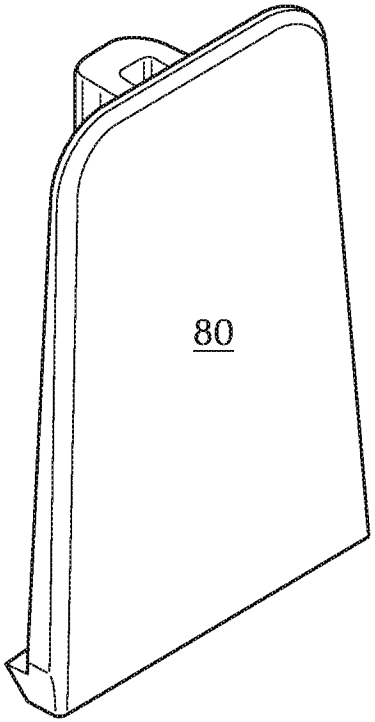
Figure 29:
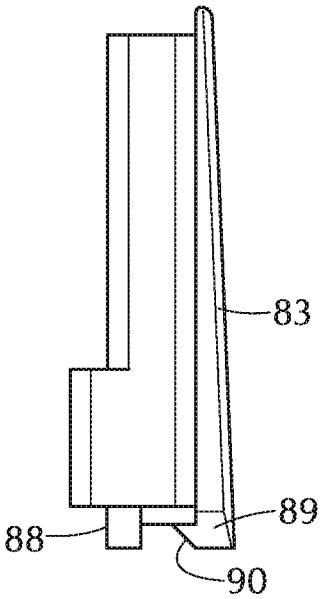
FIGS. 27-30 are right side, back, left side and front elevational views, respectively, of the product stop.
Figure 28:
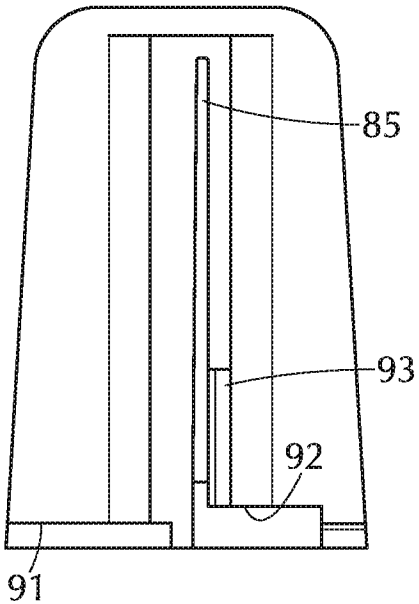
Figure 27:
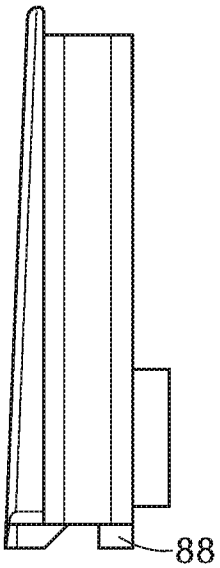
Figure 31:
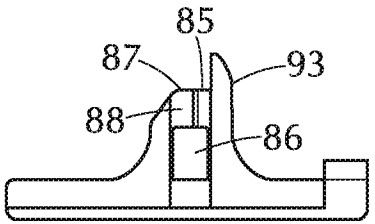
Figure 30:
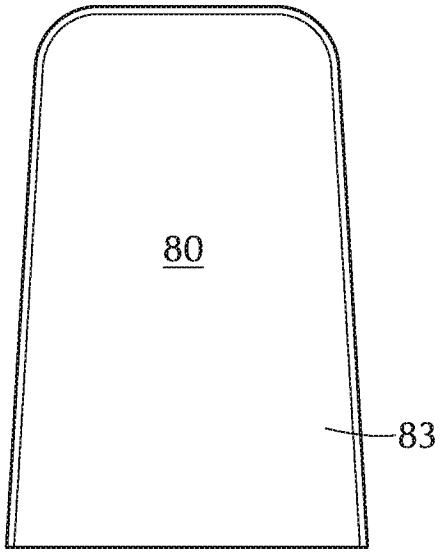
Figure 33:
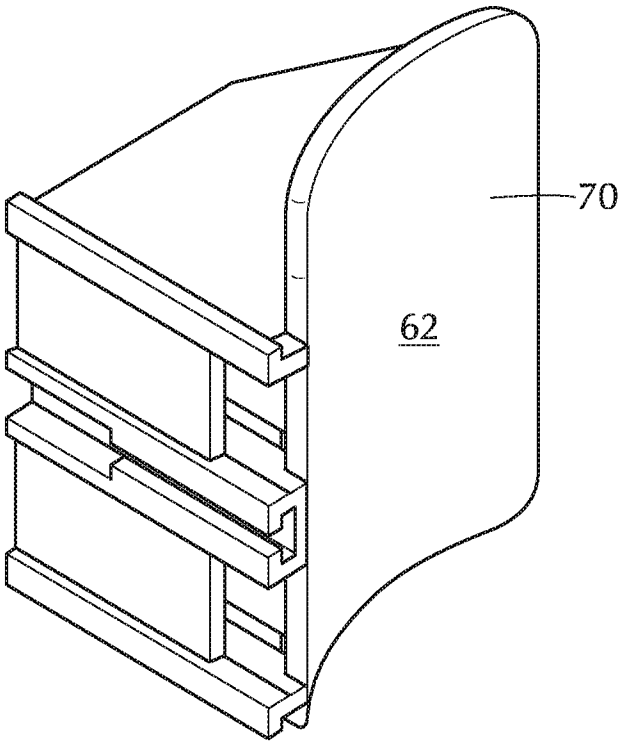
FIGS. 32-34 are orthographic views from the back, side and front, respectively, showing details of a preferred form of pusher.
Figure 32:
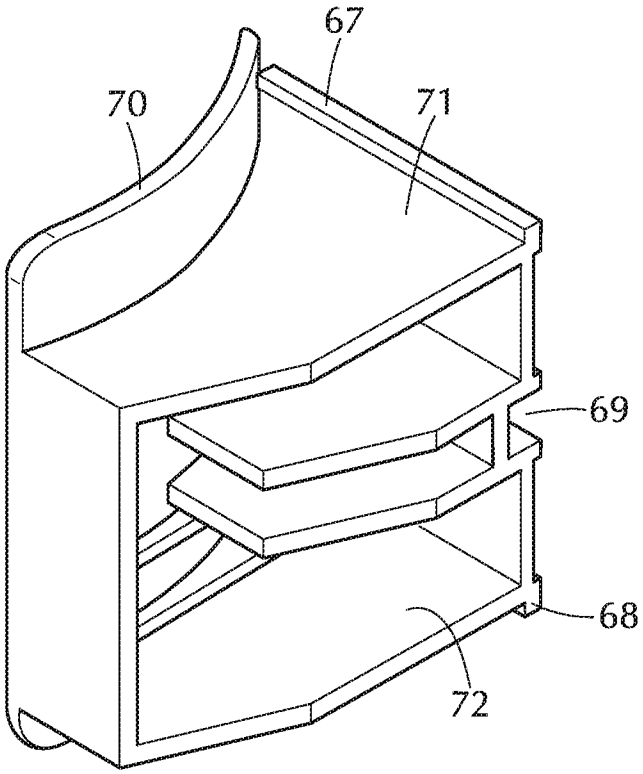
Figure 35:
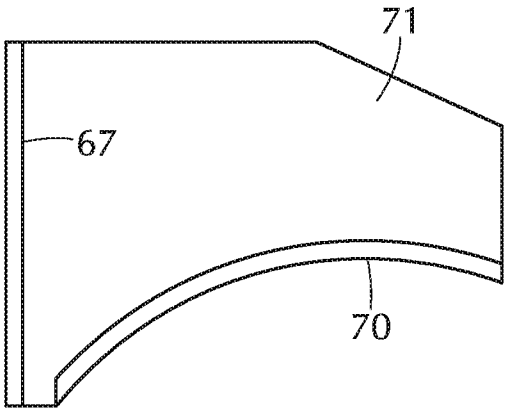
FIGS. 35-39 are top plan and back, left side, front and right side elevational views of the pusher of FIGS. 32-34.
Figure 34:
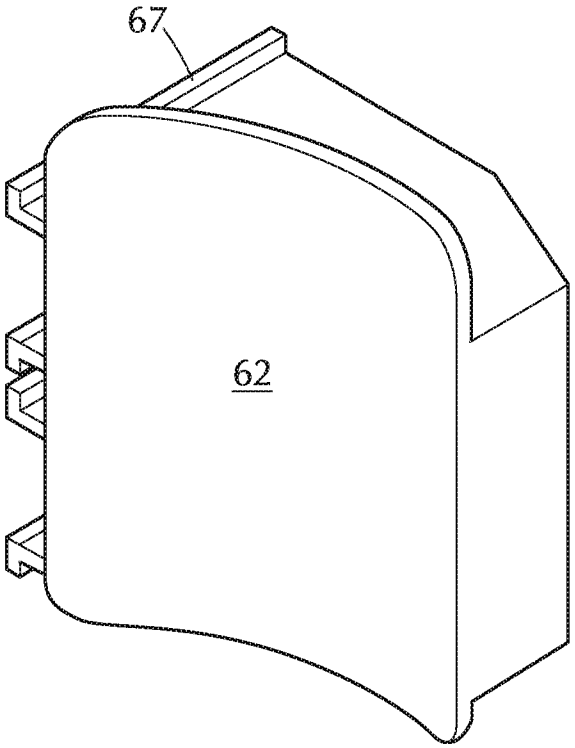
Figure 37:
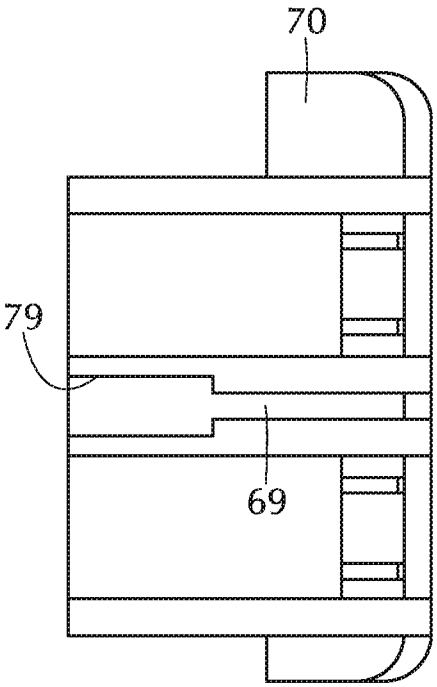
Figure 36:
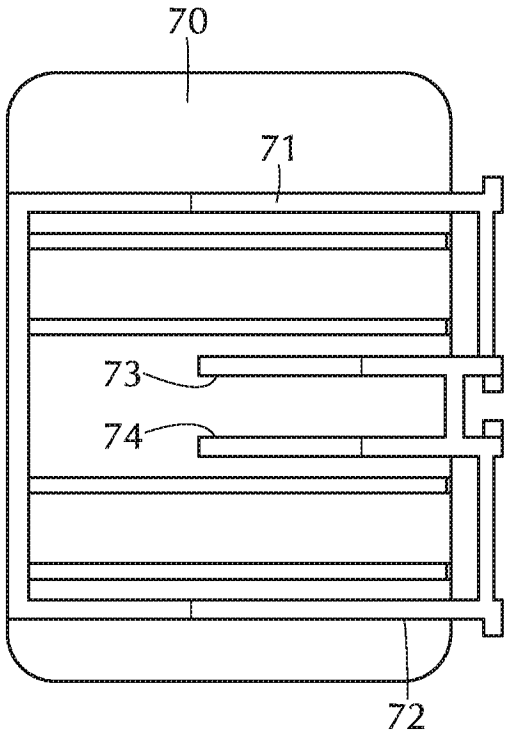
Figure 39:
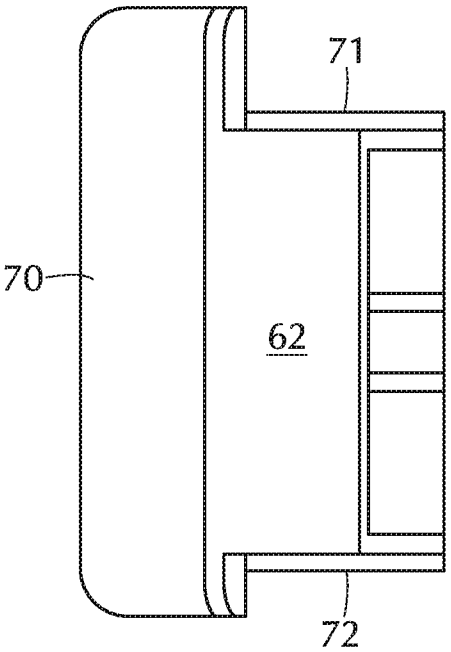
Figure 38:
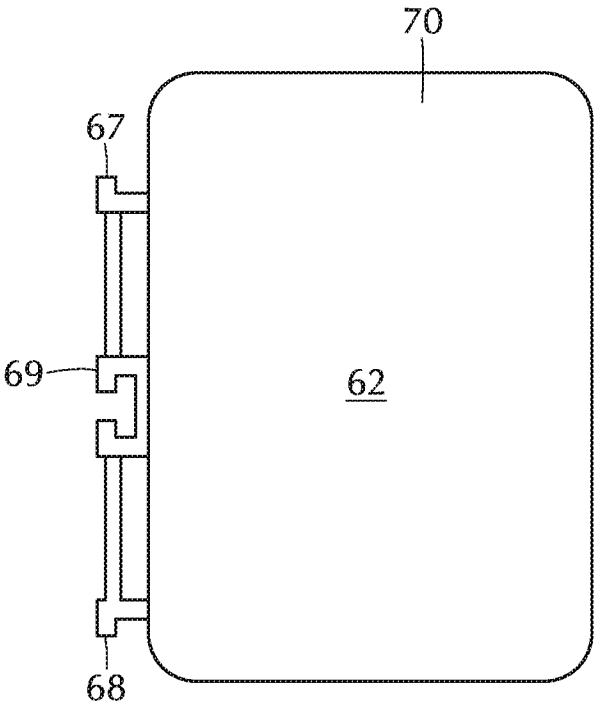
Figure 41:
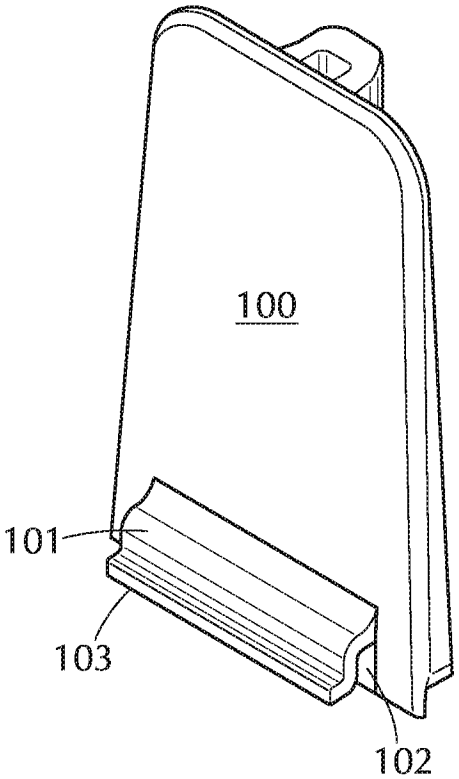
FIGS. 40 and 41 are orthographic views from the front and opposite sides of a modified form of product stop.
Figure 40:
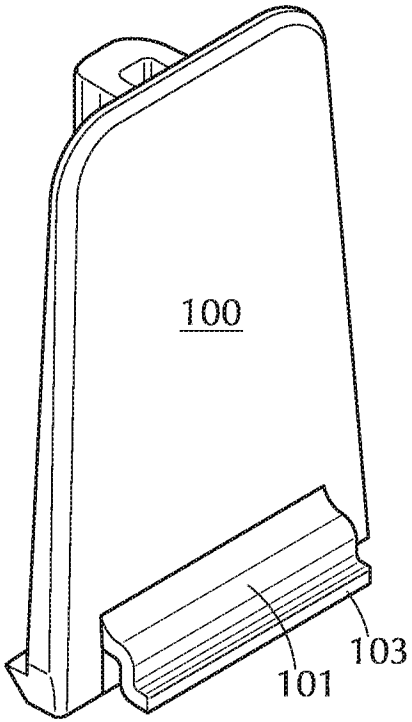
Figure 42:
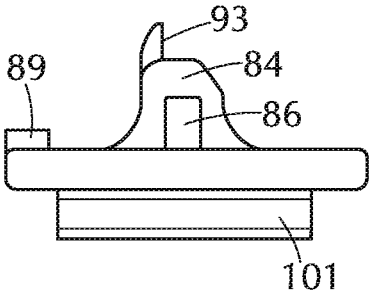
FIGS. 42 and 43 are top and bottom plan views, respectively, of the modified product stop of FIGS. 40 and 41.
Figure 43:
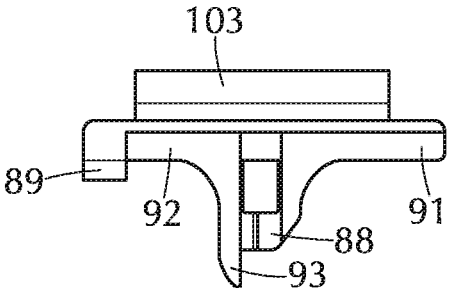
Figure 44:
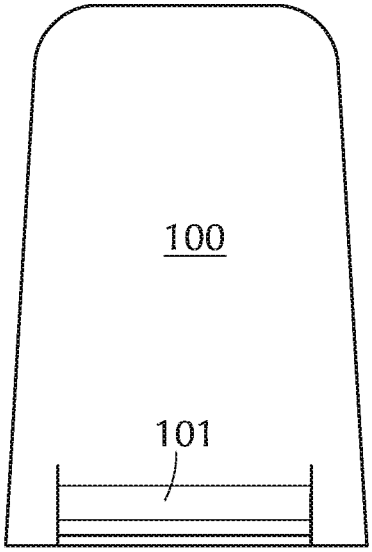
FIGS. 44 and 45 are front and side elevational views, respectively, of the modified product stop.
Figure 45:
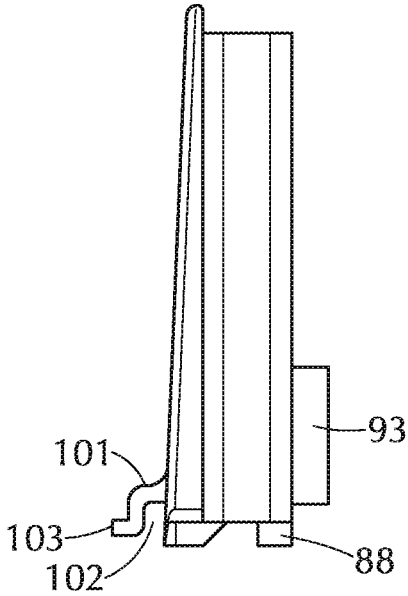
Figure 46:
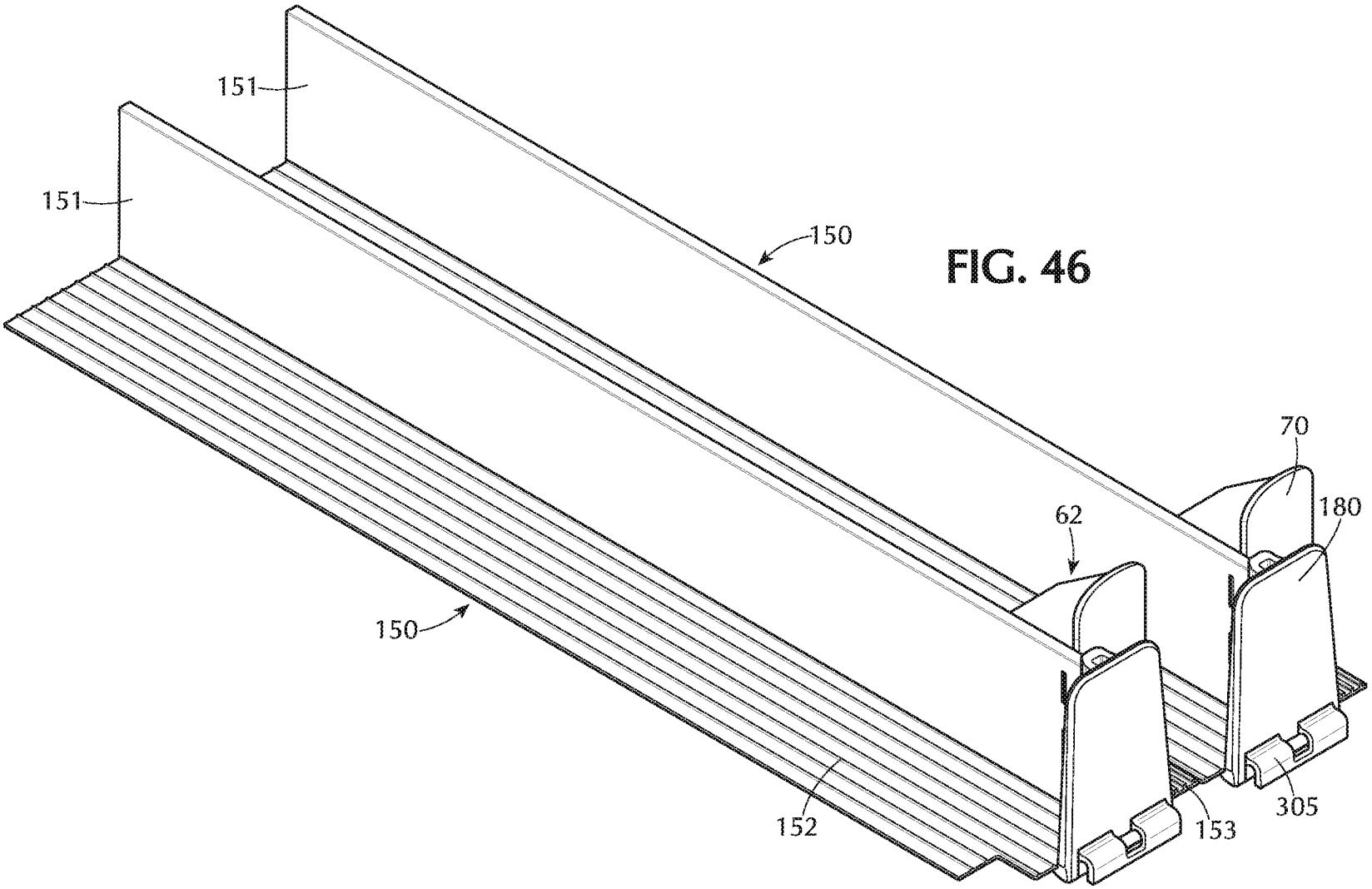
FIG. 46 is an orthographic view, from above and in front, of a modified form of the invention, shown as an assembly of two center lane members.
Figure 47:
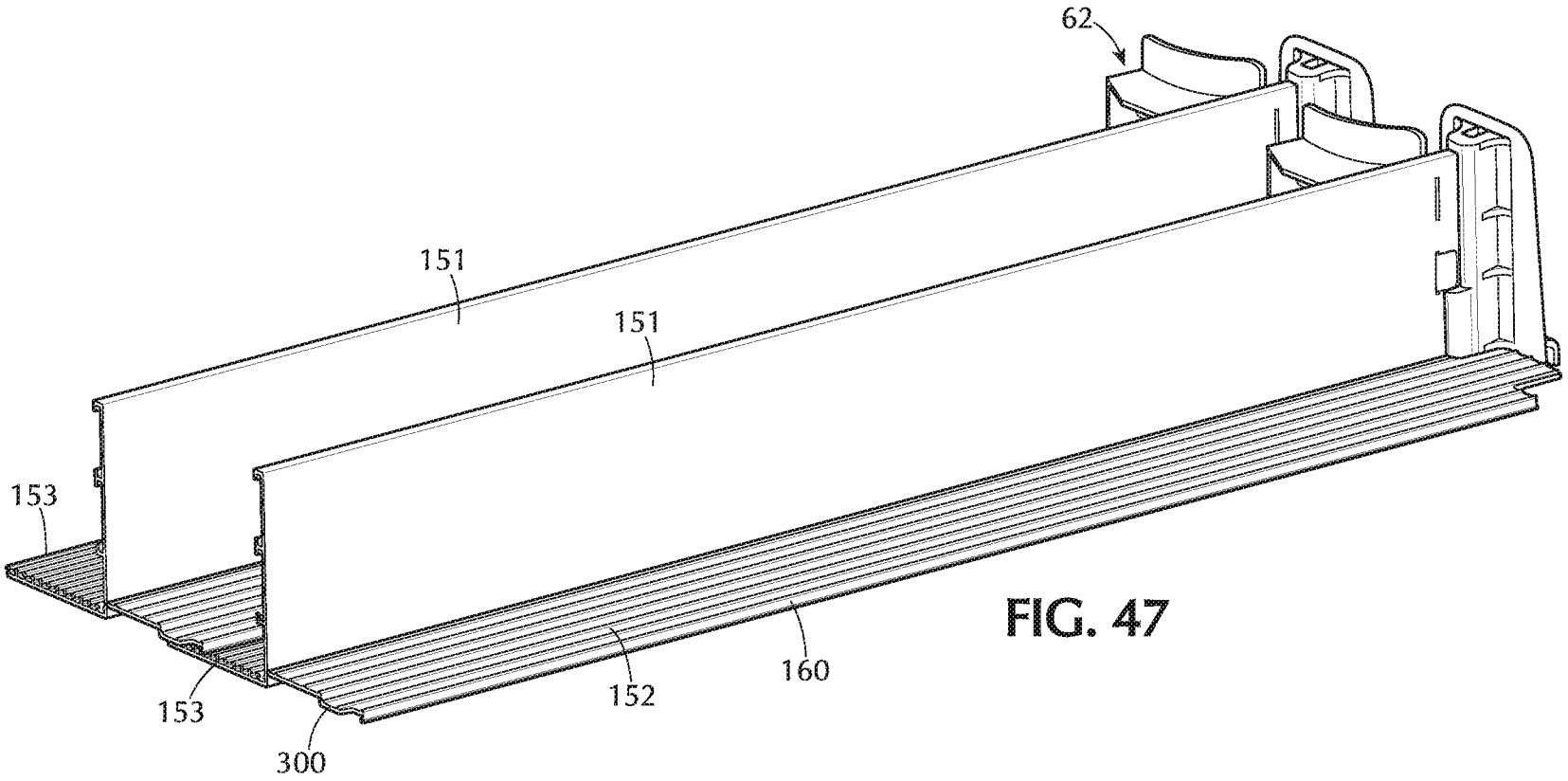
FIG. 47 is an orthographic view, from above and behind, of the assembly of FIG. 46.
Figure 48:
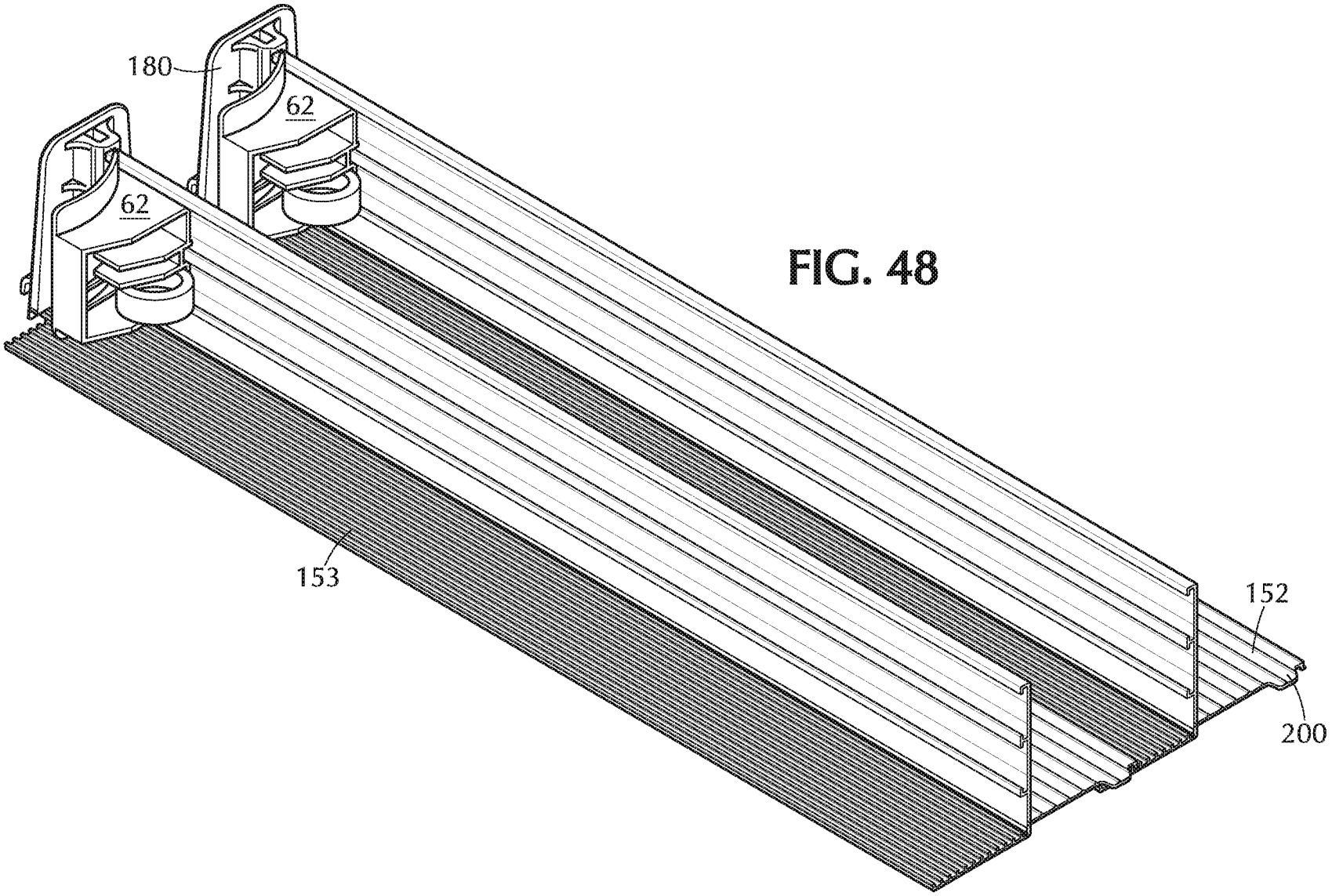
FIG. 48 is a view similar to FIG. 47 but from the opposite side of the assembly.

The back side of the pusher 62 is provided with top and bottom walls 71, 72 and intermediate walls 73, 74. These wall form chambers for receiving coiled strip springs 75 (See FIGS. 18-20). Typically, only one spring 75 will be provided with a standard assembly. However, the store keeper will have the option of adding a second spring, when appropriate, for handling large and heavy containers. The forward ends of the divider walls 51, 51*a*, 51*b* are punched to provide slotted openings 76, 77 for receiving and anchoring forward ends 78 of the springs 75 (FIG. 18). The pusher is moved to the rear of the lane for loading. Preferably, rear portions of the outer flanges of the channel 69 are cut away (FIGS. 33, 37) providing a wider opening 79 to allow a back portion of the pusher to be moved rearward of the stop 66, in order to maximize the loading capacity of the lane.

Figure 10:
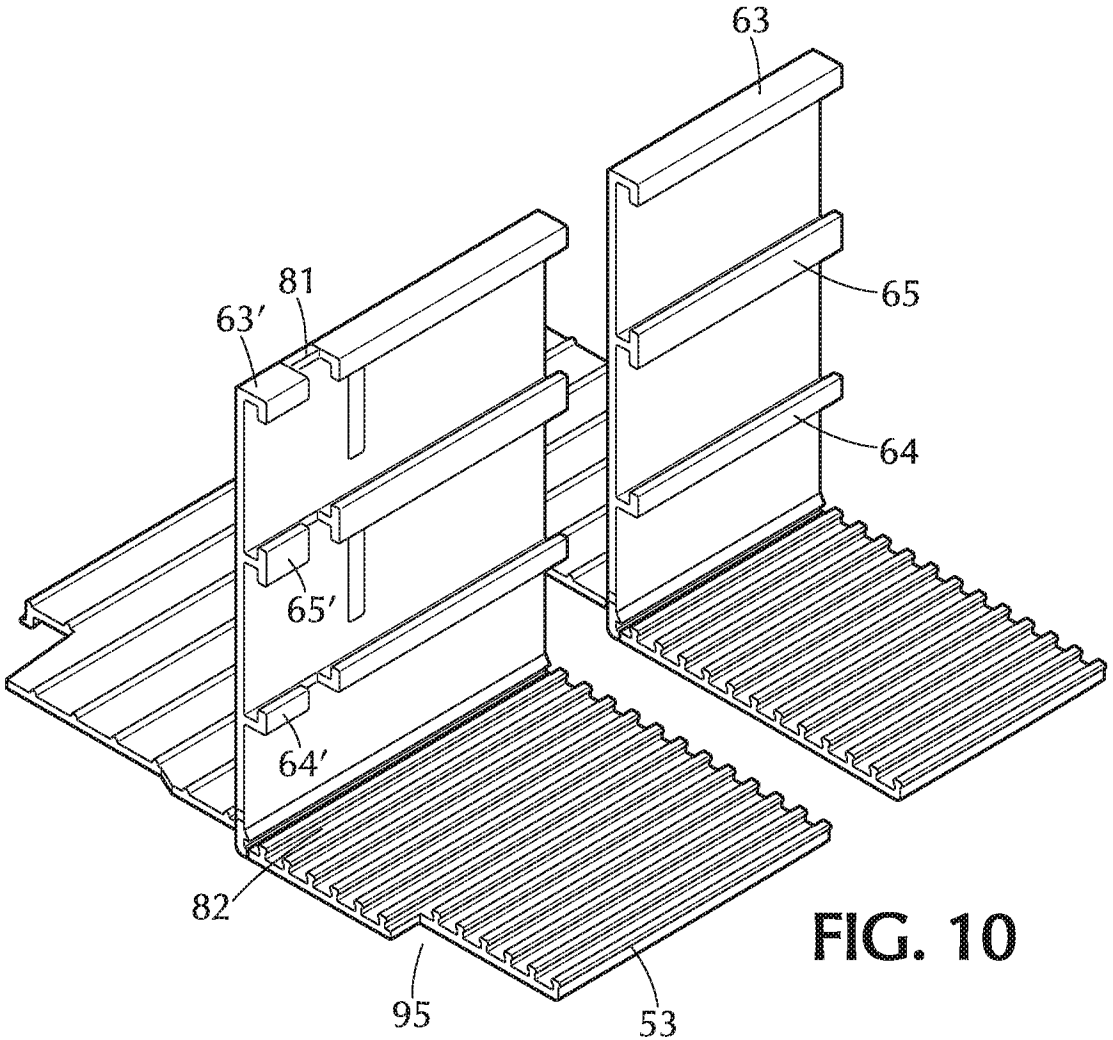
FIG. 10 is an orthographic view of a center lane member with cut-outs for the reception and mounting of a front product stop.

As shown in FIGS. 11-20, the assembly is provided with a unique and advantageous form of front product stop 80, which is a molded item, specially designed to simplify the design and cost of the mold as well as the resulting product. Initially, it will be noted in FIGS. 4, 6, 8 and 10 that the vertical divider walls 51, 51*a*, 51*b* of all lane members are provided with a vertical cut 81 through the upper and lower flanges 63, 64 and the center track 65. The lower base element 53 also is provided with a cut-out opening 82 which is aligned vertically with the vertical cut 81, as best seen in FIG. 10. The vertical cut 81 and the opening 82 are located a short distance, for example 0.4 inch from the front edge of divider wall, and are arranged to receive portions of a product stop 80 in order to lock it in position.

One embodiment of the product stop, shown in FIGS. 21-31, is molded of a rigid plastic material and comprises a front panel 83 and a rearwardly projecting, vertically oriented central ridge 84. The ridge 84 has a rearwardly opening vertical slot 85 therein of a width and height to receive the vertical divider wall 51. The slot 85 connects with a vertical passage 86 of rectangular form extending through the ridge 84. The vertical passage 86 is open at least at the bottom, and preferably at the top as well, and is of a size and shape to receive front segments 63', 64' and 65' of flanges 63, 64 and track 65 which lie forward of the vertical cut 81. A portion 87 of the ridge 84, which lies to the rear of the vertical passage 86, is of a thickness in the front-to-back direction corresponding to the width of the vertical cut 81. This allows the product stop to be installed downwardly over the front of the divider wall and be locked in place by the capture, within the vertical passage 86, of the front segments of the flanges 63, 64 and track 65 and with the rear portion 87 of the ridge being fitted into the space formed by the vertical cut 81. As indicated best in FIGS. 22, 27 and 29, the product stop 80 is also provided with a downwardly projecting element 88 of a size and shape to be closely received in the opening 82 in the lower base element 53 when the product stop 80 is fully seated on the divider wall.

To advantage, the product stop can be provided with a latch 89 at the bottom of the front panel 83, preferably at a left extremity thereof. The latch 89 has an inclined face 90 facing rearwardly and adapted to slide over the front edge of the upper base element 52, temporarily twisting the front panel 83 while the product stop is being seated, and thereafter engaging the underside of the base element 52. Once seated, the product stop 80 is locked against unintended removal.

Figure 11:
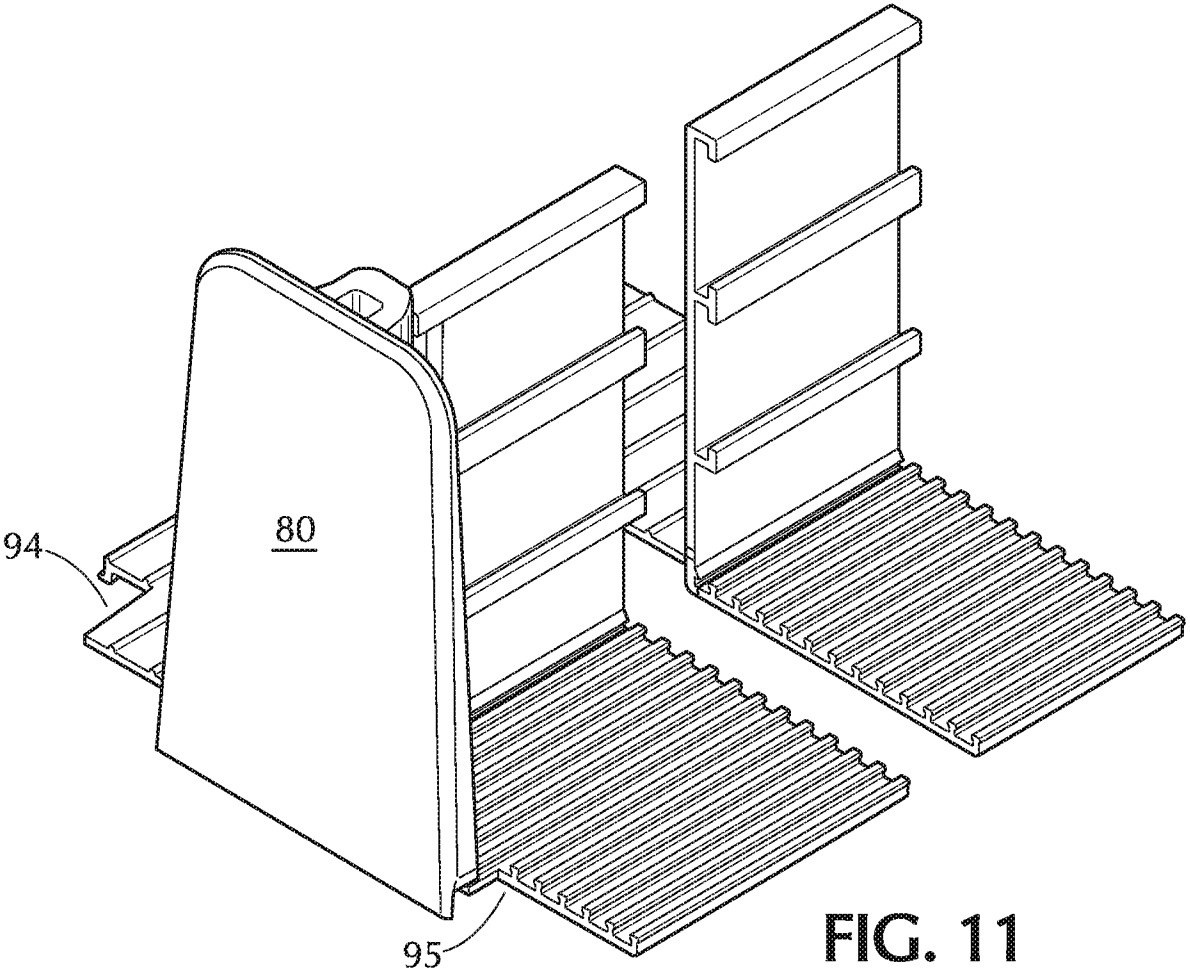
FIG. 11 is a view corresponding to FIG. 10, with a product stop mounted at the front.
Figure 12:
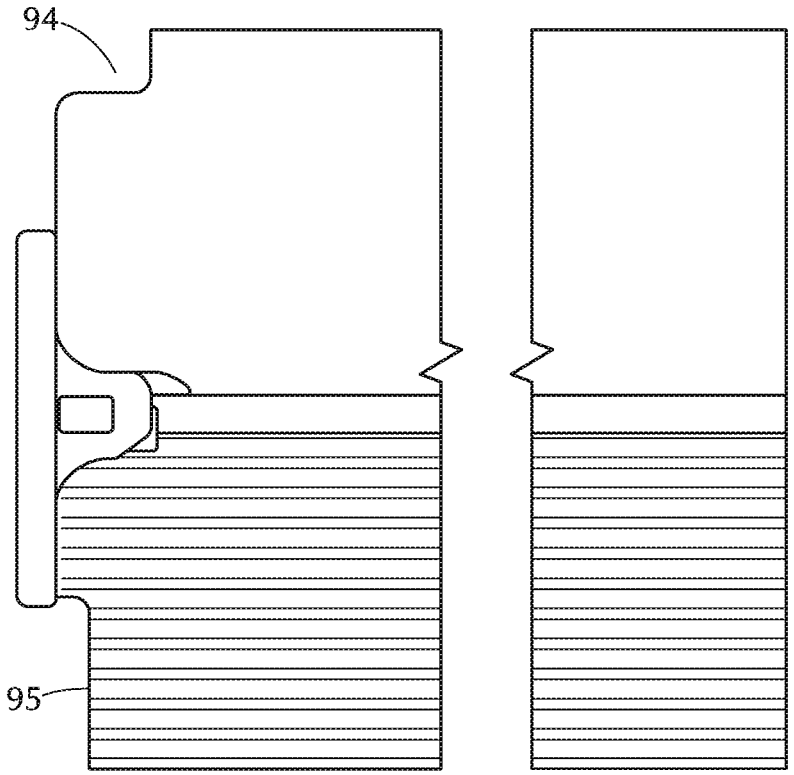
FIGS. 12-14 are top plan, and front and side elevational views of the assembly of FIG. 11.
Figure 13:
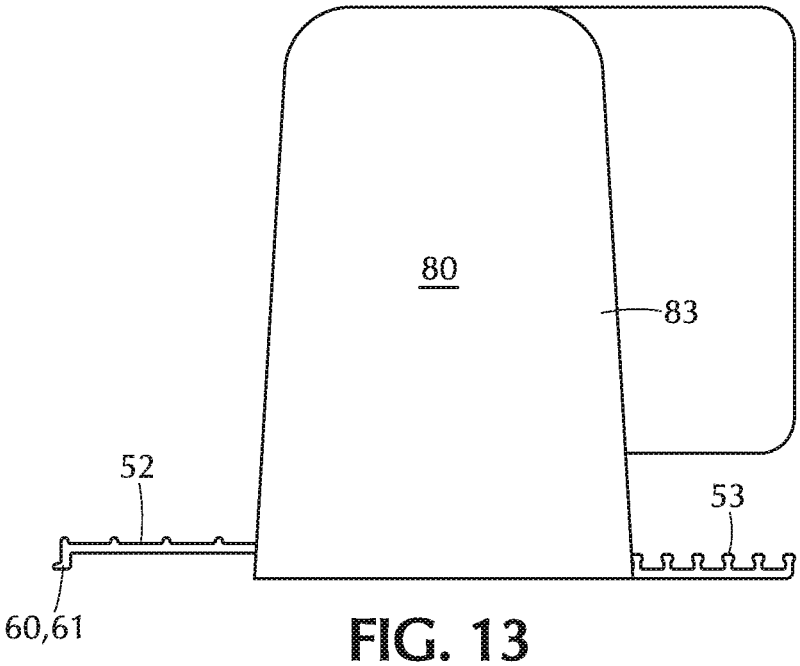
Figure 14:
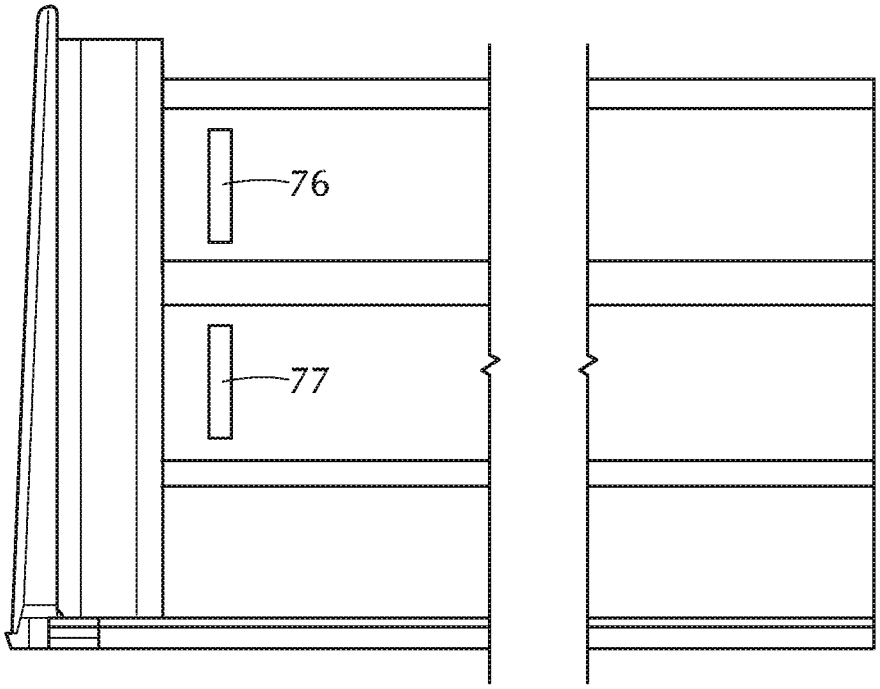
Figure 15:
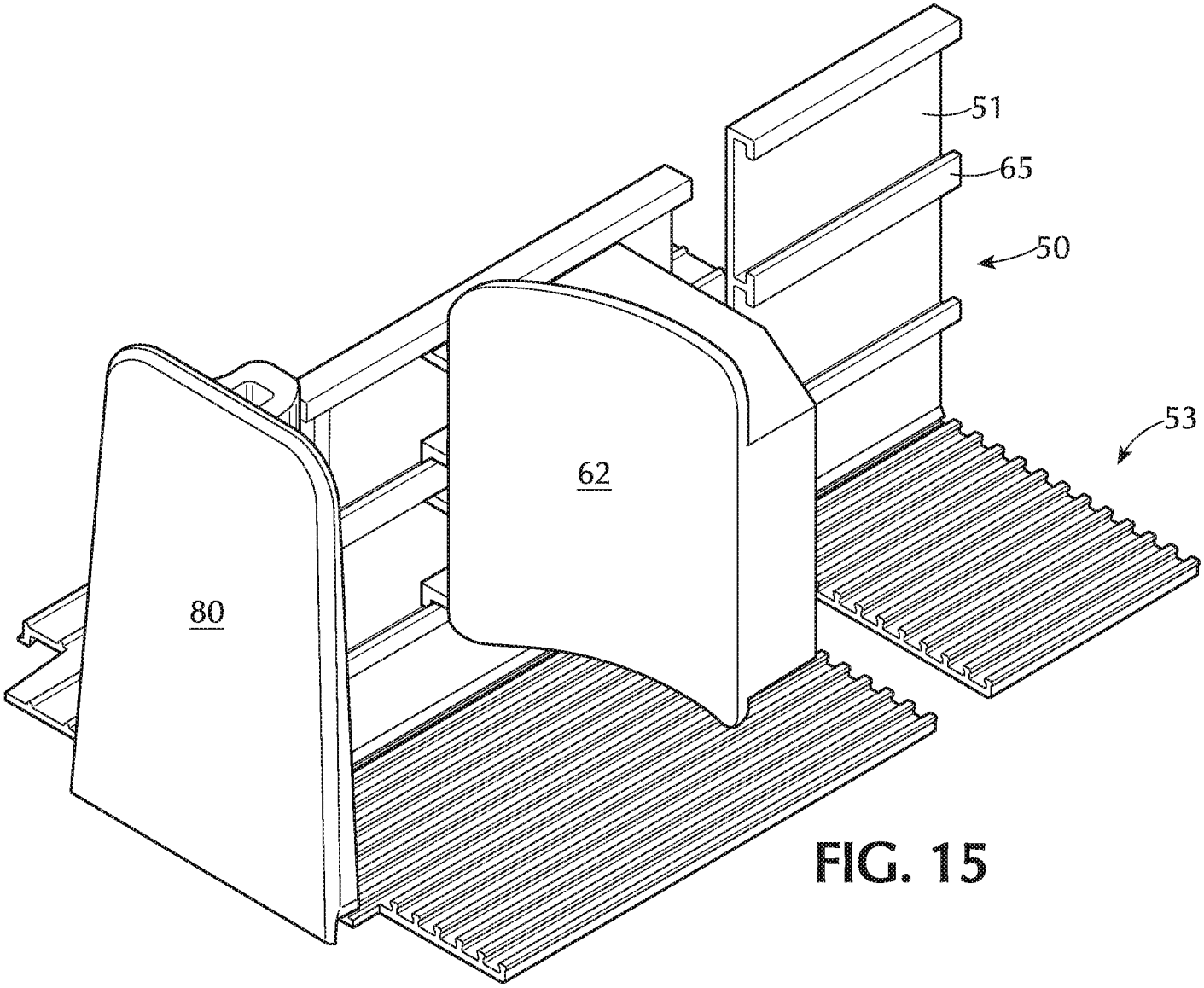
FIGS. 15 and 20 are orthographic views from front and back of a center lane assembly including a spring-actuated pusher and a front product stop.
Figure 16:
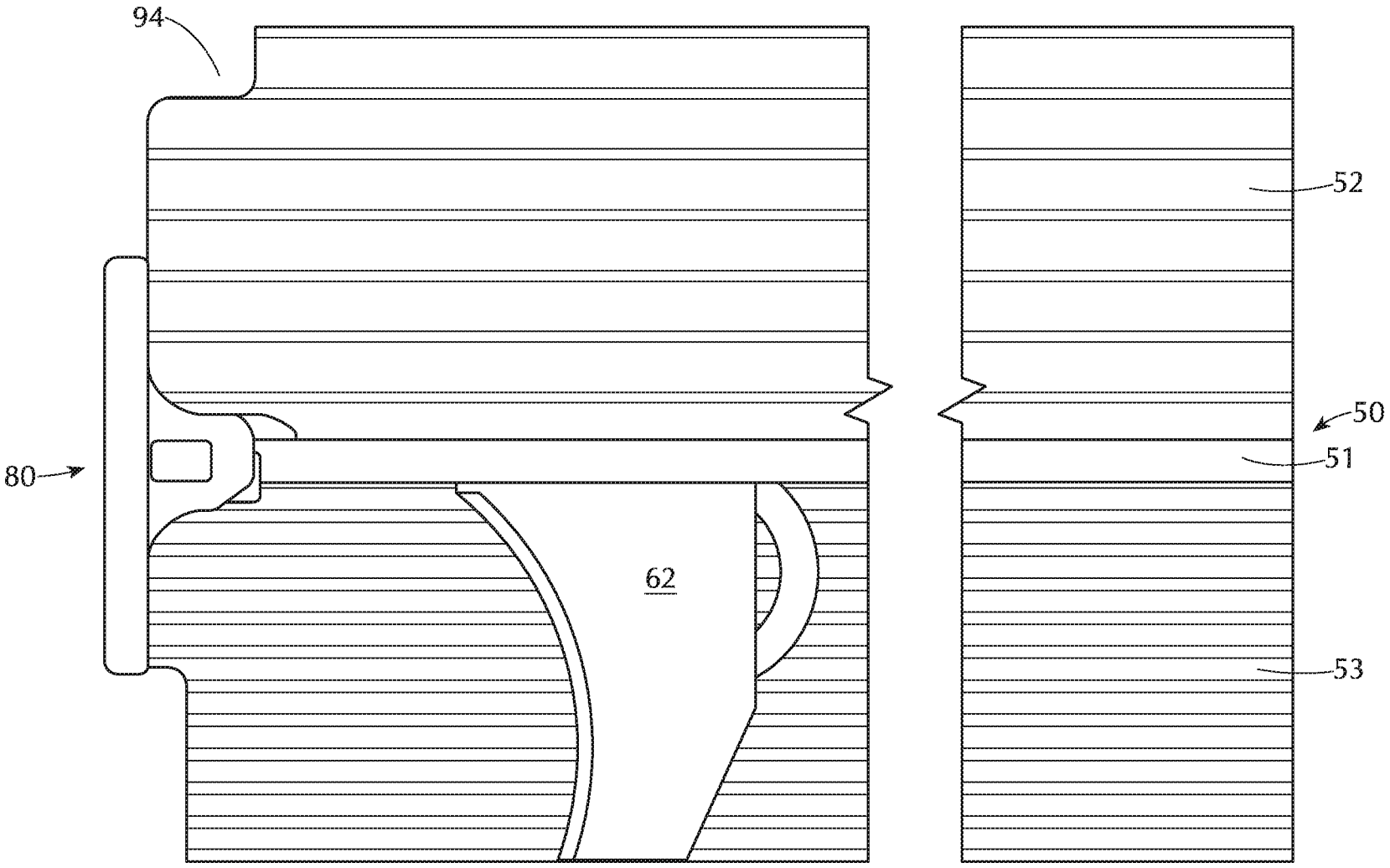
FIGS. 16-19 are top plan and front, side and rear elevational views, respectively, of the assembly of FIGS. 15 and 20.
Figure 17:
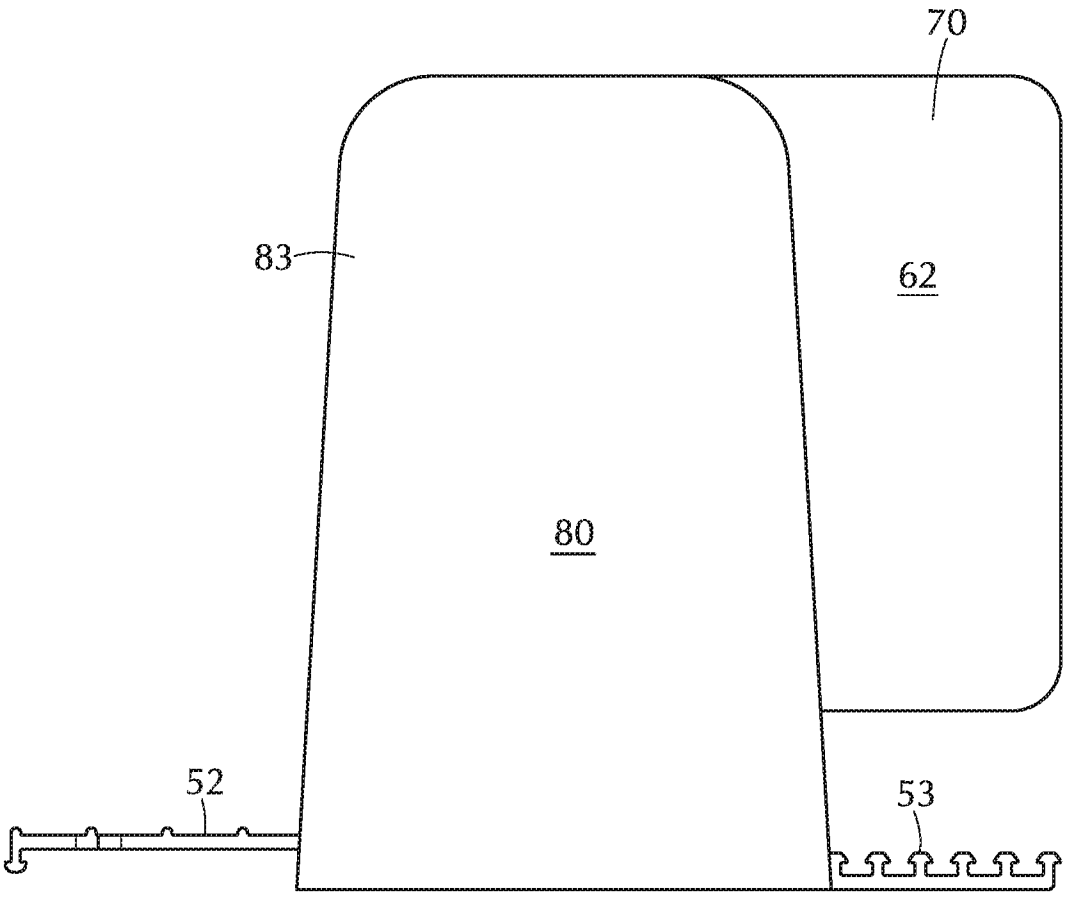

When two adjacent lane members are set at a minimum or near minimum width, the projecting element 88 and latch 89 of adjacent product stops 80 can interfere with the base elements 52, 53 of adjacent lane members. Accordingly, as indicated in FIGS. 10-12, a recess 94 is formed in the front outer corner of each upper base element 52 to enable the projecting element 88 of a product stop 80 to engage with the opening 82 of the underlying lower base element 53 of an adjacent, closely spaced lane member. Likewise, the lower base element 53 of each lane member is provided with a recess 95 to accommodate the presence of an adjacent latch 89 projecting downward from a product stop 80 mounted at the front of an adjacent lane member closely spaced on the right side of another lane member in a narrow lane width configuration.

As shown best in FIGS. 21, 26, 28 and 31, the rear of the product stop 80 is recessed at the bottom, on each side of the center, to form support surfaces 91, 92 at heights appropriate to be seated on the upper and lower base elements 52, 53, respectively. Preferably, the bottom of the front panel 83 of the product stop extends downward over the fronts of the recesses and over the front edges of the base elements 52, 53.

Preferably, the product stop 80 is provided with a stabilizing fin 93 which, when the product stop is installed, will bear against the flat left side of the vertical divider wall 51. The bottom of the stabilizing fin seats against the upper surface of the upper base element 52, and the top of the fin is set at a level to clear the bottom of a pusher 62 moving in a lane of minimum width. Product stops (not shown) associated with the left and right lane members of a shelving assembly have outer portions removed so as to not extend significantly beyond the outside vertical walls of the assembly.

FIGS. 40-45 show a modified form of product stop 100, which is similar in all respects to the product stop 80 except for the addition of an integrally molded clip 101 provided at the lower front. The clip 101 extends outward and downward and forms a downwardly opening recess 102. Many store shelf structures have a low rail (not shown) extending along the front to form a barrier for products and structures positioned on the shelf. The illustrated clip 101 is arranged to be lifted over and lowered down on the front rail, so that the rail is received within the clip recess 102, locking it, and the shelving assembly associated with it, against front or back movement on the shelf. Desirably, the clip 101 can be provided with a forwardly projecting lip 103 to facilitate gripping the clip for positioning it on (or removing it from) the front rail of a shelf. While limiting motion in a front and back direction, the rail and clip allow a lane member, or assembly of lane members, to be moved laterally.

Figure 49:
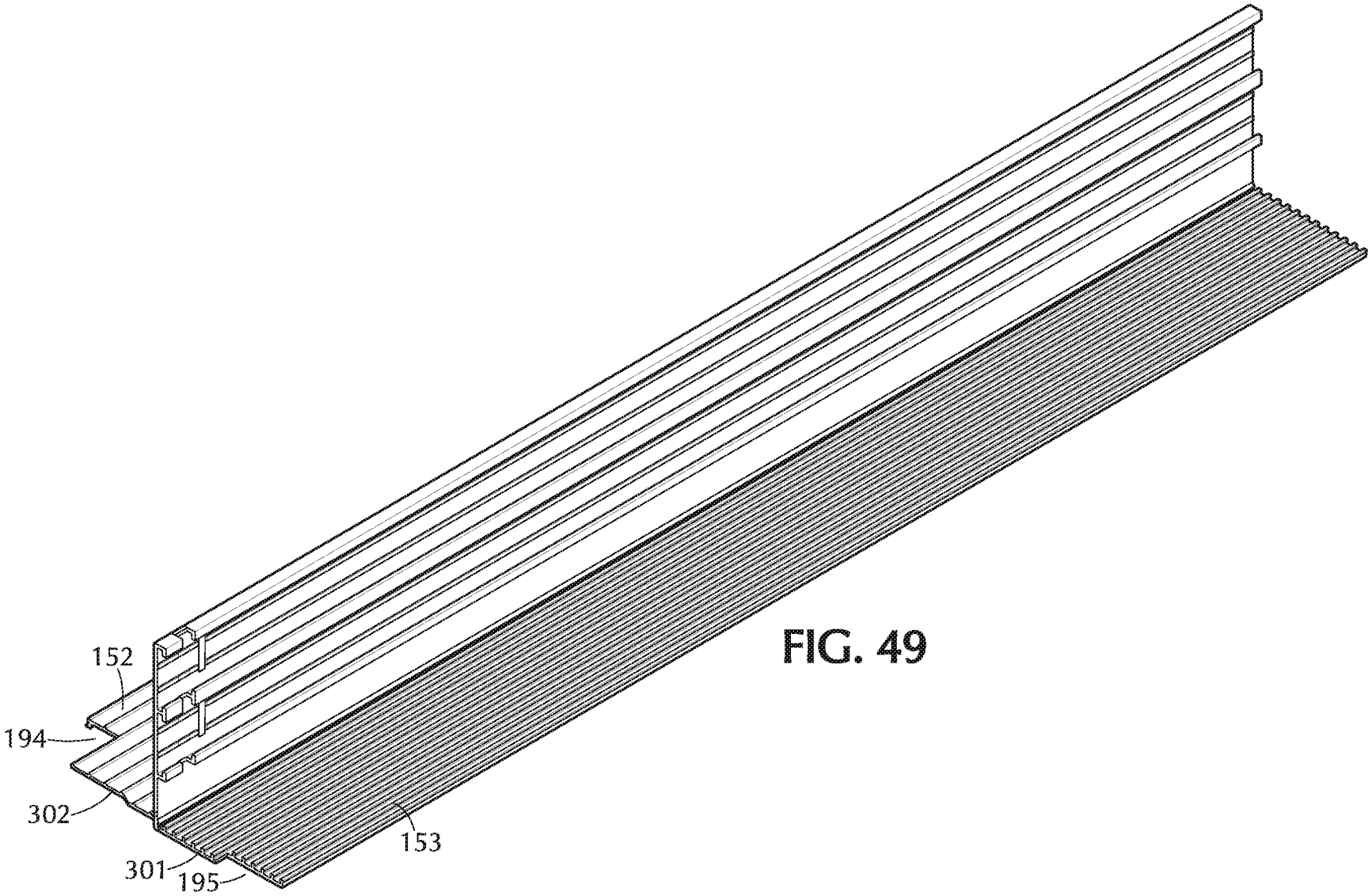
FIG. 49 is an orthographic view, from above and in front, of a center lane extrusion, showing various cuts and notches in the front edge portion thereof.
Figure 50:
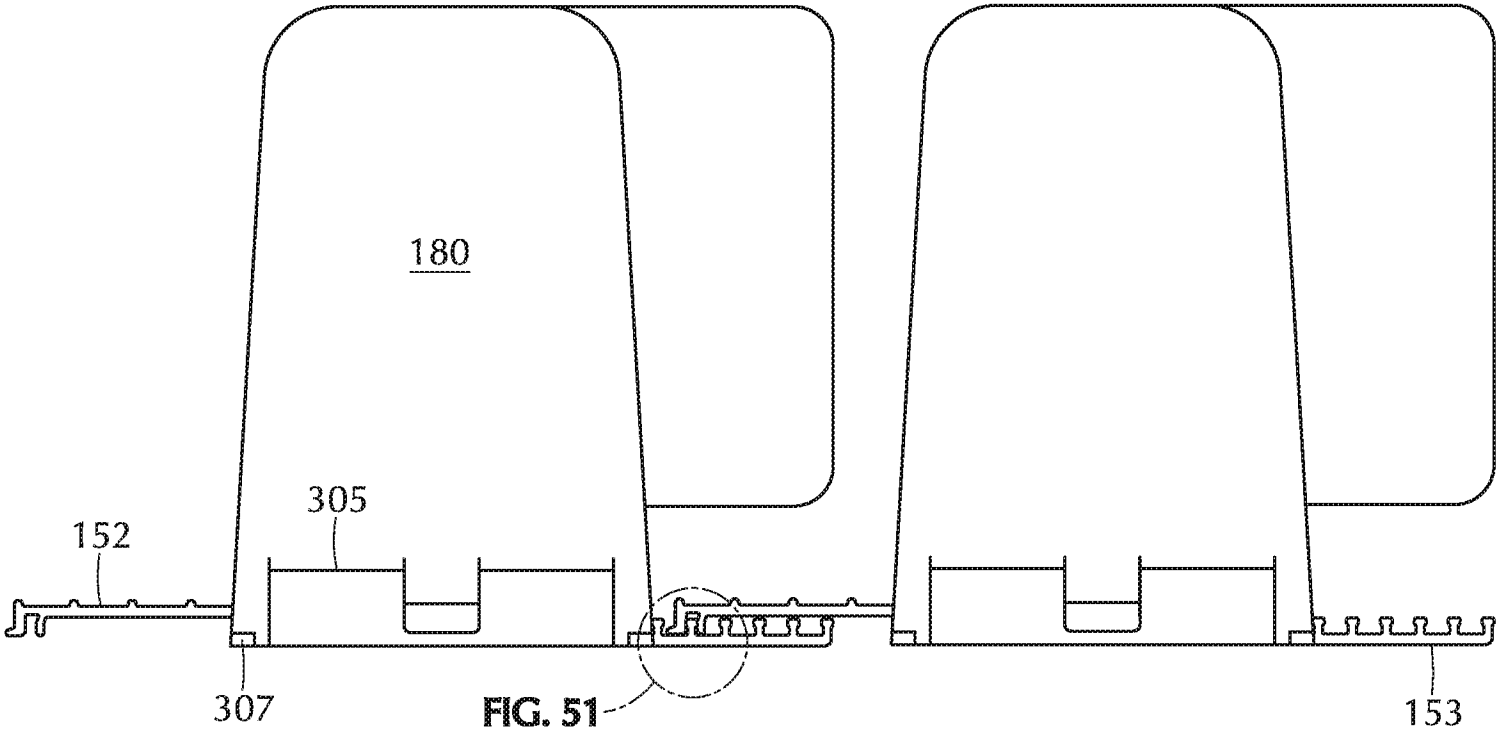
FIG. 50 is a front elevational view of the assembly of FIG. 46.
Figure 51:
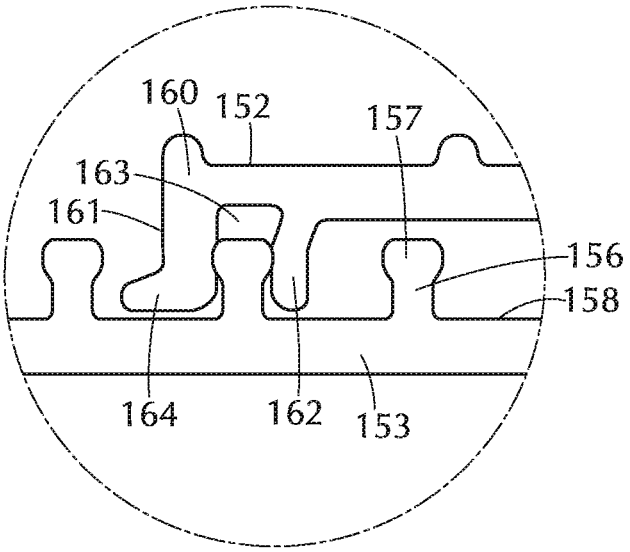
FIG. 51 is an enlarged, fragmentary detail view illustrating a modified and preferred form of structural elements for engagement of adjacent lane members.

In the modified embodiment of FIGS. 46-53, the lane members, of which two center lane members 150 are shown, have a modified and preferred form of lane engagement means. As seen in FIGS. 50 and 51, the lower base elements 153 comprise a series of closely spaced alternating grooves 158 and projecting elements 156, extending the full length of the extruded part. The projecting elements 156 are laterally enlarged at their upper end portions 157. As shown in FIG. 51, the upper base element 152 is formed at its outer edge with an engagement element 160, comprising a pair of downwardly projecting elements 161, 162 forming a downwardly opening groove 163. The groove 163 is narrower than the enlarged upper ends 157 of the projections 156 and, when pressed down upon the projections, grips them to engage the adjacent lane members in assembled relation. Since the projecting elements 156 and the engagement element 160 extend for the full length of the extrusion, the two lane members are reliably secured together, defining a product lane of desired width.

As shown in FIG. 51, the outermost projecting element 161 is formed at the bottom with an outwardly extending toe flange 164 which lies close to the bottom of the groove 158 in which it is received. Separation of connected lane members is facilitated by tilting the upper base element 152, such that the toe flange 164 engages the bottom of the groove 158 and provides leverage to initiate upward disengagement of the element 160 from the projection 156 to which it is attached. Additionally, a rearwardly projecting lifting tab 300 is provided at the back edge of the upper base element 152. This can be engaged and lifted with little effort to initiate a back-to-front separation. Thus, while the attachment of adjacent lane members is secure and reliable, intended separation, as for lane width adjustment, can be easily accomplished.

FIG. 49 illustrates a preferred profile of the front edge of a center lane member 150. At opposite front corners, there are notches 194, 195 that allow for two lane members to be connected together at minimum lane width without interference between adjacent product stops and overlapping base elements 152, 153 of the lane members on which they are mounted. A short projection 301, adjacent to the notch 195, forms the leading edge of the lane member 150 and is positioned to engage a confronting surface of a product stop. On the opposite side of the divider wall 151, a shallow notch 302 is provided in the upper base element 152. The notch 302 is aligned with the latch element 89 of a product stop and facilitates the snap-in mounting of a product stop. The remaining front edge portions of the lane member 150 are recessed slightly from the projection 301 but preferably lie in front of the shallow notch 302.

As evident in FIG. 49, the divider wall 151 of the illustrated center lane member 150 is formed, as with the previously described divider walls 51, with a vertical cut adjacent its front edge to accommodate the mounting and rigid support of a product stop 180. The product stop 180 corresponds in all respects to the previously described product stop 80, except for the downwardly opening clip 305. In some store shelving systems, a T-shaped rail (not shown) is provided along the front of the shelf. Product display units placed on such shelves can be provided with a front clip device to engage the T-shaped rail and thus be secure against front and back movement while allowing for lateral movement. A T-shaped rail can, in addition, provide for vertical restraint on the shelf display by enabling the clip to grip the underside of the rail.

Figure 53:
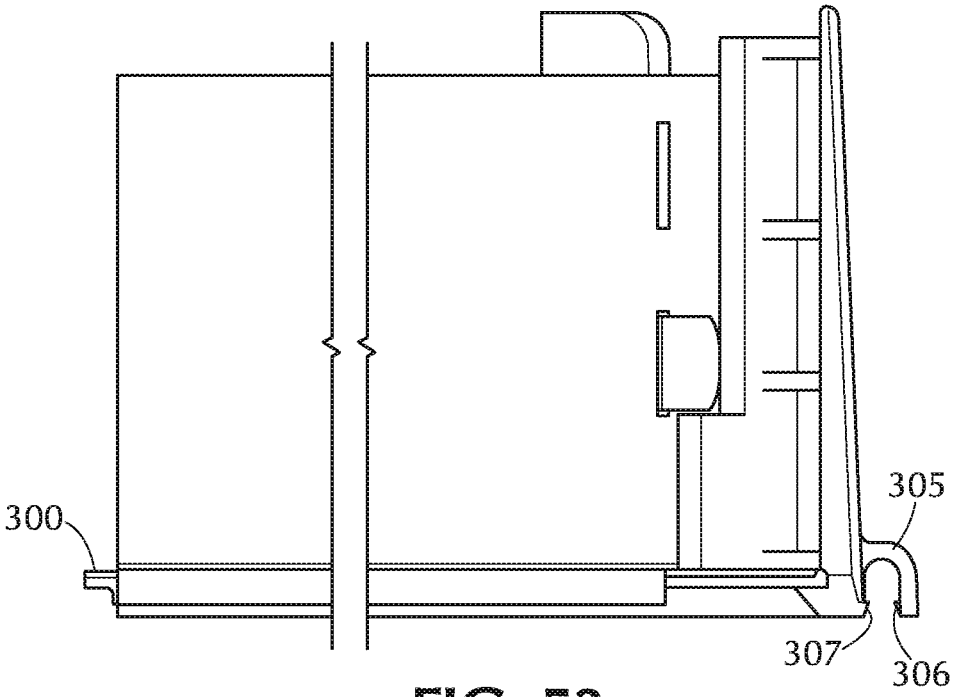
FIG. 53 is a side elevational view of the assembly of FIG. 50.
Figure 52:
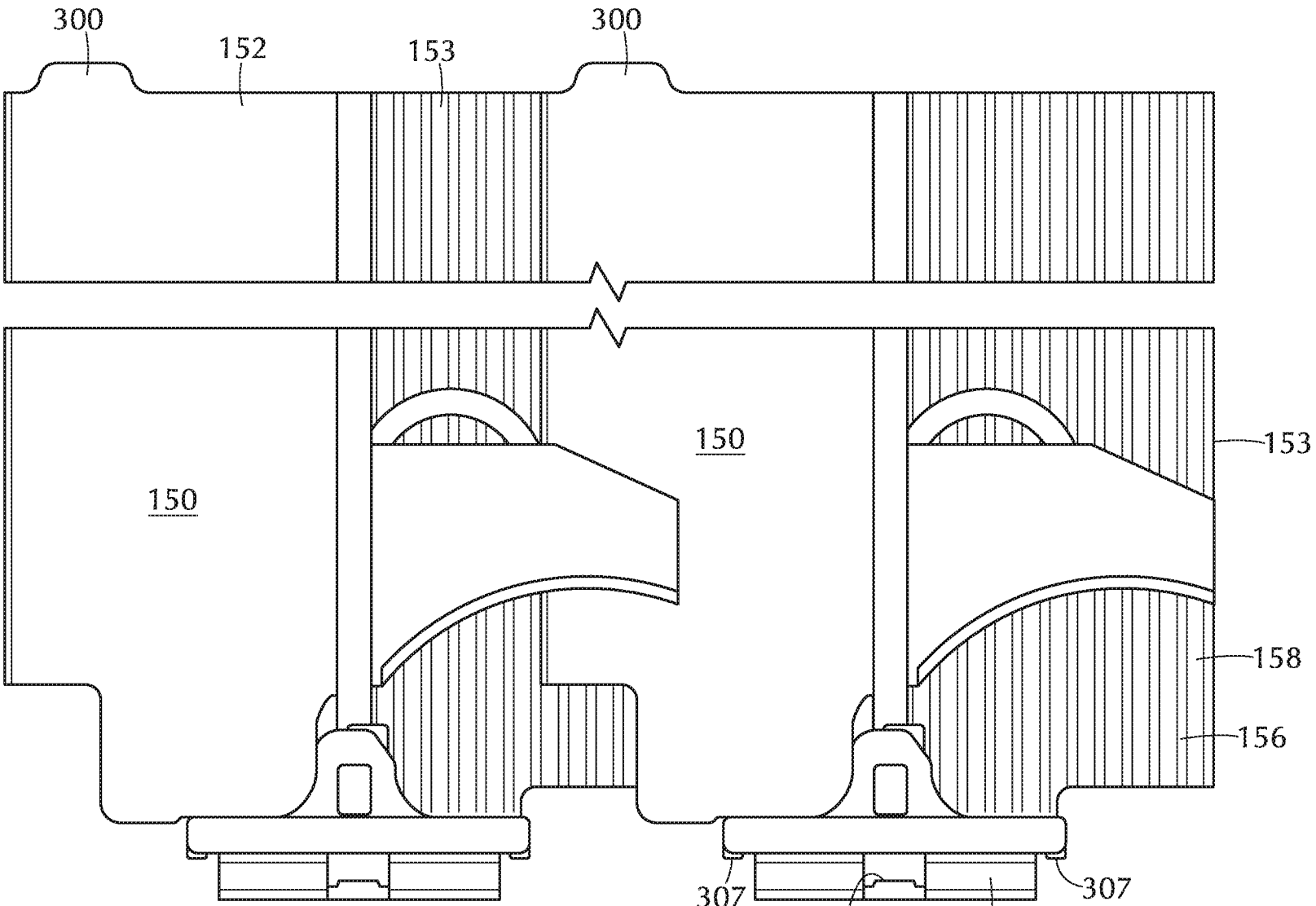
FIG. 52 is a top plan view of the assembly of FIG. 50.

With reference to FIGS. 50, 52 and 53 the rail clip 305 is formed with small barb 306 in its center, along with small barbs 307 at each side. These barbs allow the clip to be relatively easily pushed down over a T-rail, while tending to resist upward movement of the clip, as might tend to occur when a tightly held container is removed from its lane.

In accordance with the inventive concepts hereof, the lane assembly of FIGS. 46-53 provides for mounting of pushers on the vertical divider walls 151 and the vertical wall of one end lane member. The configuration of the vertical walls for this purpose is the same as previously described herein and the pushers can be the same as previously described herein.

The invention provides a highly economical, width-adjustable shelving structure which is especially desirable for, although not limited to, the display of cylindrical containers. The system of the invention utilizes simple and inexpensive extruded components in a unique and unobvious manner to enable the assembly of multi-lane display units of whatever overall width is desired by a store. It just a matter of assembling left and right lane members with any desired number of center lane members to achieve the desired overall width. Moreover, each of the individual lanes may be adjustably sized over a wide range of widths to accommodate a full range of widths of the containers to be displayed. The system is particularly useful in connection with the display of cylindrical containers, because the individual lane-forming elements are securely connected over the full length of the column of containers in order to resist any tendency of a column of cylindrical containers to press laterally outward on their confining walls. This can be a serious problem with certain types of display systems, in which sizing and positioning of the product lanes is done by attaching the lane-forming members to a structure at the front of the shelving. It can be very difficult to resist the lateral pressure applied by cylindrical containers at the back of a column, when the lane-forming components are attached only at the front.

Very commonly, the display of cylindrical containers, such as beverages, for example, is done with relatively large, molded display structures, which are very expensive to manufacture and require significant lead time in order to accommodate new sizes and configurations.

The structure of the invention utilizes economical, extruded shelving elements of a unique design consisting of any number of center lane elements combined with one left lane element and one right lane element. This arrangement greatly simplifies the ordering and inventorying of shelving components by the store keeper, and also simplifies and expedites the joining of such components into functional shelving units by simple and expeditious snap-in assembly of the individual, extruded lane elements. The new structure, providing for the mounting of pusher devices on vertical divider walls, also maximizes the number of available lane width dimensions for optimum accommodation of the wide variety of cylindrical containers including in particular small diameter container sizes.

It should be understood that the particular embodiments illustrated and described herein are representative only and are not in any way to be limiting of the full scope of the invention. Reference therefore should be made to the following appended claims in order to determine the proper metes and bounds of the invention.

What is claimed is:

1. A product display system for the display of products in individual lanes, which comprises a left side lane member in the form of an L-shaped extrusion of plastic material having a vertical side wall and a horizontal base element extending inward from said side wall, a right side lane member in the form of a reverse L-shaped extrusion of plastic material having a vertical side wall and a horizontal base element extending inward from said side wall, and one or more center lane members, each in the form of an extrusion of plastic material of inverted T-shaped configuration having a vertical divider wall and upper and lower horizontally disposed base elements extending in opposite directions from said divider wall, said lower base element being formed across a full width thereof on an upper face thereof with a plurality of longitudinally extending alternating grooves and upward projections, the upper base element of said center lane member being disposed at an elevation above that of said projections and, when joined with a lower base element of an adjacent center lane member, being configured to overlie projections of said adjacent center lane member, said upper base element being formed at an outer edge thereof with a downwardly projecting element configured for engagement with one of said grooves or projections of the lower base element of said adjacent center lane member, the base elements of said side lane members being configured for engagement with a base element of an adjacent center lane member, the vertical divider walls of the center lane members being formed on one side thereof with one or more longitudinally extending pusher mounting track elements for the optional slidable mounting of a product pusher, and the vertical side wall of at least one of said left or right side lane members being formed on a side thereof corresponding to said one side of said vertical divider walls with one or more longitudinally extending pusher mounting track elements for the optional slidable mounting of a product pusher.

2. A product display system according to claim 1, wherein product pushers are mounted on at least some of said divider walls.

3. A product display system according to claim 1, wherein the pusher mounting track elements have portions thereof, spaced from front end extremities thereof, removed along a vertical axis to form a vertical mounting slot and defining a plurality of vertically aligned track element segments in front of said vertical mounting slot, a product stop is mounted at a front of the vertical wall of at least some of the lane members, said product stops are each formed with a rearwardly and downwardly opening vertical slot therein and with a downwardly opening vertical passage therein, in front of and connected with said vertical slot, said vertical passage being of a size and shape for the reception of said vertically aligned track element segments, to position and retain said product stops at the front of the vertical walls on which they are mounted.

4. A product display system according to claim 3, wherein said vertical divider walls of said center lane members and the vertical side wall of at least one of said left or right side lane member are formed with upper, lower and central track elements adapted for mounting of a product pusher, said upper track element is located at an upper extremity of the vertical wall on which it is formed and has a first portion extending horizontally and a second portion extending downwardly to form a downwardly opening groove, said lower track element is located at a distance below said upper track element and has a first portion extending horizontally and a second portion extending upwardly to form an upwardly opening groove, and said central track element is located centrally between said upper and lower track elements and has a T-shaped form to define opposed, upwardly and downwardly opening grooves.

5. A product display system according to claim 4, wherein a product pusher is mounted on said track elements of at least certain of said lane members for longitudinal sliding movement, said product pusher is configured with upper and lower chambers, open at a back thereof configured to carry a pair of coiled springs, aligned one above the other on a vertical axis and arranged to be anchored at the front of the vertical wall on which said product pusher is mounted, said chambers being provided at a front thereof with an opening to accommodate passage of uncoiled portions of the springs, said upper, lower and central track elements form upper and lower guide tracks for the retention of uncoiled portions of one or both of said coiled springs, and forward portions of said guide tracks are formed with a slot, extending through the vertical wall, for anchoring engagement with forward extremities of said coiled springs.

6. A product display system according to claim 3, wherein a portion of said product stop extends below a front edge of one of the base elements on the lane member on which the product stop is mounted and said portion has a snap-in locking engagement with said front edge to secure said product stop in position.

7. A product display system according to claim 1, wherein the vertical side walls of both of said left and right side lane members are formed, on a side corresponding to said one side of said divider walls, with one or more longitudinally extending pusher mounting track elements for the optional slidable mounting of a product pusher.

8. A product display system for the display of products in individual lanes, which comprises a left side lane member in the form of an L-shaped extrusion of plastic material having a vertical side wall and a horizontal base element extending inward from said side wall, a right side lane member in the form of a reverse L-shaped extrusion of plastic material having a vertical side wall and a horizontal base element extending inward from said side wall, and one or more center lane members, each in the form of an extrusion of plastic material of inverted T-shaped configuration having a vertical divider wall and upper and lower horizontally disposed base elements extending in opposite directions from said divider wall, said lower base element being formed across a full width thereof on an upper face thereof with a plurality of laterally spaced, longitudinally extending alternating upward projections and upwardly opening grooves defined by said upward projections, the upper base element of said center lane member being disposed at an elevation above that of said projections and being configured to overlie projections of a lower base element of a center lane member positioned adjacent thereto, said upper base element being formed at an outer edge thereof with a downwardly projecting element configured for engagement with one of said grooves or projections of the lower base element of said center lane member positioned adjacent thereto, the base elements of said side lane members being configured for engagement with a base element of an adjacent center lane member, the vertical divider walls of the center lane members being formed on one side thereof with one or more longitudinally extending pusher mounting track elements for the slidable mounting of a product pusher, the vertical side walls of said left and right side lane members being formed on a side thereof corresponding to said one side of said vertical divider walls with one or more longitudinally extending pusher mounting track elements, and product pushers are mounted on the track elements of the vertical divider walls of said center lane members and on the track elements of the vertical side wall of one side lane member whose track elements are facing a vertical divider wall of a center lane member connected to said one side lane member.

9. A product display system according to claim 8, wherein said upward projections are formed with enlargements at upper ends thereof, said downwardly projecting element comprises laterally spaced elements forming a downwardly opening groove, and said downwardly opening groove is sized and configured to engage and grip a selected one of said upward projections.

10. A product display system according to claim 9, wherein an outermost one of said laterally spaced elements that form said downwardly opening groove is formed at a bottom thereof with a laterally outwardly extending toe flange positioned adjacent to a bottom surface of the upwardly opening groove in which it is received, said toe flange being configured to act against said groove bottom surface when said upper base element is tilted upwardly, to assist in the removal of said downwardly projecting element from the groove in which it is received.

11. A product display system according to claim 8, wherein said downwardly projecting element defines a downwardly opening groove configured for engagement with an upward projection of said lower base element.

12. A product display system for the display of products in individual lanes, which comprises a left side lane member in the form of an L-shaped extrusion of plastic material having a vertical side wall and a horizontal base element extending inward from said side wall, a right side lane member in the form of a reverse L-shaped extrusion of plastic material having a vertical side wall and a horizontal base element extending inward from said side wall, and one or more center lane members, each in the form of an extrusion of plastic material of inverted T-shaped configuration having a vertical divider wall and upper and lower horizontally disposed base elements extending in opposite directions from said divider wall, said lower base elements of said center lane members being disposed at a height to underlie at least portions of said upper base elements of adjacent center lane members and being configured for laterally adjustable engagement with said upper base elements to form product lanes of different widths, the vertical divider walls of said center lane members and the vertical side walls of said side lane members being formed on one side thereof, facing in a common direction, with vertically spaced apart, longitudinally extending projections, said longitudinally extending projections, adjacent to forward ends of said vertical walls, being interrupted over a predetermined distance by vertically aligned cutaway portions therein forming a plurality of vertically aligned segments of said projections at forward extremities of said vertical walls, a product stop element of molded plastic material comprising a front panel, and a vertically oriented ridge projecting rearwardly from said front wall, said ridge being formed with a vertical passage therein, open at the bottom thereof, of a size and shape to receive said vertically aligned segments to support and align said product stop, said ridge further being formed with a vertical slot therein, open at the bottom thereof, for the reception of portions of said vertical walls in the regions of said vertical cut-away portions therein.

13. A product display system according to claim 12, wherein said longitudinally extending projections comprise pusher-mounting tracks.

14. A product display system according to claim 12, wherein base elements, extending from said one side of said vertical walls, in regions lying below and aligned with said cut-away portions, are formed with an opening, and the ridge of said product stop is formed with a downwardly projecting element which is received in said base element opening when said product stop is mounted at a front of a vertical wall.

15. A product display system according to claim 12, wherein said front panel, at a side thereof of said upper base member, is formed with a rearwardly projecting retaining latch engagable with an underside of the upper base member to prevent unintended removal of said product stop from the vertical wall on which it is mounted.

16. A product display system according to claim 15, wherein said front panel, at a bottom thereof, is formed with a rearwardly and downwardly opening recess, forming downwardly facing surfaces, supported by front portions of underlying upper and lower base members, and a rearwardly facing positioning surface projecting downward over front edge extremities of said underlying base members, and said upper base member is formed with a forwardly opening notch recessed from said front edge extremities to accommodate passage of said retaining latch, said latch being formed at bottom back portion thereof with an inclined surface to facilitate downward assembly of said product stop.

17. A product display system according to claim 16, wherein said lower base member is formed with a forwardly and laterally opening notch extending laterally outward from a point adjacent to a side of said product stop front panel to the side edge extremity of said lower base member to accommodate the positioning of a product stop front panel of an adjacent center lane member in a configuration of minimum lane width.

18. A product display system according to claim 17, wherein said upper base member is formed with a forwardly and laterally opening notch extending laterally outward from a point adjacent to a side of said product stop ridge to the side edge extremity of said upper base member to accommodate the positioning of an adjacent center lane member in a configuration of minimum lane width.

19. A product display system for the display of products in individual lanes, which comprises, a plurality of center lane-forming members, each in the form of an extrusion of plastic material of inverted T-shaped configuration having a vertical divider wall and upper and lower horizontally disposed base elements extending in opposite directions from said divider wall, said lower base element being formed across a full width thereof on an upper face thereof with a plurality of longitudinally extending alternating grooves and upward projections, the upper base element of said center lane-forming member being disposed at an elevation above that of said projections and, when joined with a lower base element of an adjacent center lane-forming member being configured to overlie projections of the lower base element of said adjacent center lane-forming member, said upper base element of said center lane-forming member being formed at an outer edge thereof with a downwardly projecting element configured for engagement with one of said grooves or projections of the lower base element of said adjacent center lane-forming member, the vertical divider walls of said center lane-forming members being formed on one side thereof with one or more longitudinally extending pusher mounting track elements for the optional slidable movement of a product pusher, said plurality of center lane-forming members being connected in laterally adjacent relation to form a plurality of product display lanes of laterally variable width.

20. A product display system according to claim 19, further including left side and right side lane members, each having a vertical wall and a horizontally extending base element engageable with and connected to an outwardly extending base element of a laterally outermost one of said connected center lane-forming members.

21. A product display system according to claim 20, further characterized by the base element of one of said left side or right side lane members corresponding in structure and function to the upper base element of a center lane-forming member and the base element of the other of said left side or right side lane members corresponding in structure and function to the lower base element of a center lane-forming member.

* * * * *